US010767897B2

(12) United States Patent
Yu et al.

(10) Patent No.: US 10,767,897 B2
(45) Date of Patent: Sep. 8, 2020

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Hui Yu, Foshan (CN); Yuanshun Huang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 16/704,630

(22) Filed: Dec. 5, 2019

(65) Prior Publication Data

US 2020/0109876 A1 Apr. 9, 2020

Related U.S. Application Data

(63) Continuation of application No. PCT/CN2019/073166, filed on Jan. 25, 2019.

(30) Foreign Application Priority Data

Mar. 5, 2018 (CN) ..... 2018 2 0301081 U
Mar. 5, 2018 (CN) ..... 2018 2 0301648 U
Mar. 5, 2018 (CN) ..... 2018 2 0301650 U
Mar. 5, 2018 (CN) ..... 2018 2 0302085 U

(51) Int. Cl.
*F24F 13/28* (2006.01)
*F24F 1/027* (2019.01)
*F24F 13/32* (2006.01)

(52) U.S. Cl.
CPC ..... *F24F 13/28* (2013.01); *F24F 1/027* (2013.01); *F24F 13/32* (2013.01)

(58) Field of Classification Search
CPC .. F24F 13/28; F24F 13/32; F24F 1/027; F24F 1/02; F24F 3/1603; F24F 2003/1639; B60H 3/0608
See application file for complete search history.

(56) References Cited

U.S. PATENT DOCUMENTS 5,542,263 A 8/1996 Choi et al.
2007/0060036 A1* 3/2007 Shibuya ..... F24F 13/28 454/187
2018/0023821 A1* 1/2018 Kim ..... F24F 1/0025 62/264

FOREIGN PATENT DOCUMENTS

CN 201476176 U 5/2010
CN 102147130 A 8/2011
CN 103375906 A 10/2013
(Continued)

OTHER PUBLICATIONS

World Intellectual Property Organization (WIPO) International Search Report for PCT/CN2019/073166 dated Mar. 25, 2019 8 Pages.

*Primary Examiner* — Emmanuel E Duke
(74) *Attorney, Agent, or Firm* — Anova Law Group PLLC

(57) ABSTRACT

An air conditioner includes a base including a first fixation member, a front panel including a second fixation member, and a filter. A first end of the filter is detachably connected to the first fixation member, and a second end of the filter is detachably connected to the second fixation member. At least one of the base or the front panel includes a supporting member abutting against the filter to cause the filter to bend in an arc shape.

20 Claims, 10 Drawing Sheets

(56) References Cited

FOREIGN PATENT DOCUMENTS

| | | | |
|---|---|---|---|
| CN | 106662360 | A | 5/2017 |
| CN | 208025644 | U | 10/2018 |
| CN | 208025684 | U | 10/2018 |
| CN | 208025811 | U | 10/2018 |
| CN | 208025812 | U | 10/2018 |

* cited by examiner

WINDOW AIR CONDITIONER

CROSS-REFERENCE TO RELATED APPLICATIONS

This application is a continuation of International Application No. PCT/CN2019/073166, filed on Jan. 25, 2019, which claims priority to Chinese Patent Application Nos. 201820301650.3, 201820301648.6, 201820301081.2, and 201820302085.2, all filed with the Chinese Patent Office on Mar. 5, 2018, the entire contents of all of which are incorporated herein by reference.

FIELD

The present disclosure relates to the field of air conditioners and, more particularly, to a window air conditioner.

BACKGROUND

In an existing window air conditioner, a filter is laid flat at the air inlet to filter the airflow. In the process of realizing the present disclosure, the inventors have found that the following problems exist in the conventional technologies: the lay-flat filter has a limited filtering area and cannot achieve a very good filtering effect, and the lay-flat filter has the problem of large wind resistance, which causes varying degrees of air pressure loss and air volume loss and reduces the energy efficiency of the equipment, and in the case of multi-direction air intake of the equipment, a plurality of filters at different angles need to be designed separately to adapt to the adjustment for multi-direction air intake, which increases the complexity of the equipment, and increases the work involved in mounting and dismounting of the filters, resulting in the problem of inconvenient use.

SUMMARY

In view of this, there is a need for a window air conditioner capable of solving at least one of the above-mentioned technical problems.

A window air conditioner, comprising: a base provided with a first fixation member; a front panel provided with a second fixation member; and a filter, one end of which is detachably connected to the first fixation member, and the other end of which is detachably connected to the second fixation member, a supporting member being arranged on at least one of the base or the front panel, and the supporting member abutting against the filter, so that the filter is configured to be in an arc shape.

Compared with the conventional technologies, the present disclosure has the following advantageous technical effects: the arc-shaped filter structure in the present disclosure has a larger filtering area, can improve the filtering efficiency, and has reduced resistance loss when an airflow comes into contact with a surface of the arc-shaped filter, thereby reducing the losses of air pressure and air volume, improving the energy efficiency of the equipment, and reducing the noise of the airflow at the filter. In addition, the arc-shaped filter can realize multi-angle inlet air filtration, and in the case of multi-direction air intake of the equipment, it is only needed to adjust the arc radian and bending direction to adapt to the air intake angle, without the need to provide a plurality of filters for filtering separately, which reduces the number of filters, while meeting the filtering need, and saves the work involved in mounting and dismounting of the filter and facilitates the daily cleaning of products. Moreover, by connecting the filter to the second fixation member on the front panel, the user can integrally take the filter out from the position of the front panel for cleaning, which makes it more convenient for the user to take the filter out and improves the use experience of the product.

In addition, the window air conditioner in the above-described embodiment provided by the present disclosure can also have the following additional technical features:

In the above-described technical solution, one of the first fixation member and the second fixation member is a guide rail groove or a guide rail, the filter is provided with a track adapted to be slidably connected with the guide rail groove or the guide rail, the filter is slidably connected to the guide rail groove or the guide rail, and the filter is shaped, by the guide rail groove or the guide rail, to be adapted to a track shape of the guide rail groove or the guide rail.

Specifically, for example, when one of the first fixation member and the second fixation member is a guide rail groove, the track is a guide rail that can be slidably fitted with the guide rail groove, and when one of the first fixation member and the second fixation member is a guide rail, the track is a guide rail groove that can be slidably fitted with the guide rail. The structure is simple, realizes operation ease and convenience of assembly and disassembly between the filter and the base or the front panel, and facilitates daily cleaning of the filter by the user. Moreover, by making use of the characteristic that while the filter is slidably assembled by means of the guide rail groove or the guide rail, the guide rail groove or the guide rail is adapted to and matched with the track, the guide rail groove or the guide rail can be used to support and shape the filter, in order to assist in configuring the filter into an arc shape, thereby enabling the filter to be more stably kept in an arc shape, and preventing spring back of the filter.

In the above-described technical solution, the track shape of the guide rail groove or the guide rail is oblique line-shaped or arc-shaped.

While assisting in configuring the filter into an arc shape, this structure can facilitate the processing and manufacturing of the product due to its simple shape, is more conducive to ensuring smooth sliding of the track of the filter in the guide rail groove, and facilitates daily disassembly and cleaning of the filter by the user.

In any of the above-described technical solutions, an entrance of the guide rail groove is configured to have a trumpet shape.

This can facilitate the insertion of the track of the filter along the entrance of the guide rail groove, thereby facilitating daily assembly, disassembly and cleaning of the filter by the user.

In any of the above-described technical solutions, a surface of the entrance of the guide rail groove is an arc surface.

It can be understood that since the guide rail groove has certain shaping and supporting effect on the filter, there is an internal stress transition between a state of being shaped by the guide rail groove and a state of not being shaped by the guide rail groove in a portion of the filter in the vicinity of the entrance of the guide rail groove. In this design, the surface at the entrance of the guide rail groove is configured to be an arc surface, which can help the filter to adapt to the change of its internal stress in shape to form an appropriate bending shape transition, and prevent the filter from being broken due to an excessively large bending angle. Moreover, the arc-shaped surface leads to small friction and wear when coming into contact with the filter, which can avoid the problem of scratching of the filter by the guide rail groove and ensure the product quality.

In any of the above-described technical solutions, the filter is provided with two tracks that are spaced apart from each other, the supporting member comprises a first supporting rib, and a portion of the filter located between the two tracks is supported by the first supporting rib.

Slidably connecting the two tracks of the filter with two guide rail grooves or guide rails respectively can enable the filter to slide more smoothly along the guide rail grooves or the guide rails, and providing a first supporting rib to support and shape the filter can prevent a portion of the filter that is not supported or reinforced by the guide rail groove or the guide rail from collapsing and deforming, thereby effectively ensuring that the filtering area of the filter is not reduced, and ensuring the operation energy efficiency of the equipment.

In any of the above-described technical solutions, the other one of the first fixation member and the second fixation member comprises a locking groove, the filter is provided with a convex rib corresponding to the locking groove, and the convex rib and the locking groove are so adapted that the convex rib is snapped into the locking groove so as to fix the filter.

By snapping the convex rib of the filter into the locking groove, the filter is detachably fixed, that is, unlocking can be realized just by digging the convex rib out from the locking groove at the time of cleaning, which has the advantages of simple structure and convenient use and operation.

In the above-described technical solution, the other one of the first fixation member and the second fixation member further comprises a stopping member located at a groove opening of the locking groove and configured to limit the convex rib in the locking groove.

The convex rib is limited in the locking groove by using a stopping member, so that the filter is fixed and prevented from falling off, which ensures that the filter is fixed stably and reliably.

In any of the above-described technical solutions, the supporting member further comprises a second supporting rib having an arc shape, and the convex rib is snapped into the locking groove so that the filter is pressed against a surface of the second supporting rib.

By pressing the filter against the surface of the second supporting rib when the convex rib is snapped into the locking groove, the filter can be prevented from collapsing and deforming, thereby effectively ensuring that the filtering area of the filter is not reduced and ensuring the operation energy efficiency of the equipment.

In some embodiments, one surface of the filter is supported by the first supporting rib and the other surface of the filter is supported by the second supporting rib, and in some embodiments, a portion of the filter supported by the first supporting rib is offset from a portion of the filter supported by the second supporting rib.

In any of the above-described technical solutions, the filter is provided with a clasp, and the clasp is lifted to disengage the convex rib from the locking groove.

A clasp is provided at the filter, and the clasp is configured to: disengage the convex rib from the locking groove when the clasp is lifted. The clasp allows the user to apply a force to unlock the convex rib from locking groove, which has the advantages of simple structure and convenient use and operation.

In any of the above-described technical solutions, at least one of the front panel or the base is provided with an air inlet.

In any of the above-described technical solutions, the window air conditioner further comprises: a heat exchanger disposed on the base.

The heat exchanger of the window air conditioner is arranged on the base of the window air conditioner. In this solution, the first fixation member is designed on the base for assembly and cooperation with the filter, so that the heat exchanger and the filter can be positioned with the same reference, which ensures accurate alignment and matching of the filter and the heat exchanger. In this way, by accurately placing the filter at an upstream position of the heat exchanger, it is possible to effectively filter the airflow upstream of the heat exchanger to prevent dust from contaminating the heat exchanger and avoid the problem of clogging the heat exchanger.

In any of the above-described technical solutions, the window air conditioner further comprises: a cross-flow impeller; and a heat exchanger adjacent to the cross-flow impeller, the vertical distance between a surface of the heat exchanger and an outer surface of the cross-flow impeller being 14 mm-25 mm.

It's worth saying that when the window air conditioner is running, the airflow will be influenced by the structures such as the heat exchanger, the cross-flow impeller and the volute air duct in the process of passing through the heat exchanger and the cross-flow impeller, to produce multiple variations of pressure increase and pressure decrease, which will result in relatively large airflow noise in the volute air duct. In this solution, by controlling the vertical distance between the surface of the heat exchanger and the outer surface of the cross-flow impeller to be greater than or equal to 14 mm, the airflow noise during the operation of the equipment can be reduced, and by controlling the vertical distance between the surface of the heat exchanger and the outer surface of the cross-flow impeller to be smaller than or equal to 25 mm, the size of the equipment can be reduced, it can be effectively ensured that there is no reduction or loss in the air pressure and air volume of the cross-flow impeller, and the operation efficiency of the cross-flow impeller can be ensured.

In the above-described technical solution, the heat exchanger is a multi-section structure, and an angle is formed between any two adjacent sections in the multi-section structure, so that the heat exchanger is recessed as a whole, and the cross-flow impeller is located at one side of the heat exchanger that is inwardly recessed.

By designing the heat exchanger as a multi-section structure and arranging the heat exchanger on the outer side of the cross-flow impeller in such a manner as to surround half of the cross-flow impeller, simple structure is achieved and multi-angle air intake and heat exchange can be realized, which improves effective heat exchange area and heat exchange efficiency of the heat exchanger, and is also more conducive to reducing the size of the equipment, and ensures that the cross-flow impeller will experience no reduction or loss in air pressure and air volume, so as to ensure the operation efficiency of the cross-flow impeller.

In the above-described technical solution, the window air conditioner further comprises: a volute tongue plate, one section of the multi-section structure being a first heat exchange section, one end of the first heat exchange section being adjacent to the volute tongue plate, and the vertical distance between a surface of the first heat exchange section and the outer surface of the cross-flow impeller being 14 mm-25 mm.

In this way, it is possible to prevent the distance between the first heat exchange section adjacent to the volute tongue plate and the outer surface of the cross-flow impeller from being too small, thereby preventing the generation of an airflow vortex at the first heat exchange section and at a portion of the cross-flow impeller adjacent to the first heat exchange section, making it possible to avoid the problem of noise superposition at the volute tongue plate and reduce the energy loss of the airflow. Moreover, it is also possible to prevent the distance between the first heat exchange section and the outer surface of the cross-flow impeller from being too large, thereby making it possible to prevent the problem of turbulent flow caused by an excessively large difference in flow velocity between the airflow at the surface of the volute tongue plate and the airflow at the position of the first heat exchange section adjacent to the position of the volute tongue plate and at the position of the cross-flow impeller, which is also more conducive to reducing the size of the equipment, and ensures that there is no reduction or loss in air pressure and air volume of the cross-flow impeller, so as to ensure the operation efficiency of the cross-flow impeller.

In the above-described technical solution, the vertical distance between the surface of the first heat exchange section and the outer surface of the cross-flow impeller is 14 mm-22 mm.

In this way, it is possible to further prevent the distance between the first heat exchange section and the outer surface of the cross-flow impeller from being too large, thereby preventing the problem of turbulent flow caused by an excessively large difference in flow velocity between the airflow at the surface of the volute tongue plate and the airflow at the position of the first heat exchange section adjacent to the position of the volute tongue plate and at the position of the cross-flow impeller, which is also more conducive to reducing the size of the equipment, and ensures that there is no reduction or loss in air pressure and air volume of the cross-flow impeller, so as to ensure the operation efficiency of the cross-flow impeller.

In some embodiments, the vertical distance between the surface of the first heat exchange section and the outer surface of the cross-flow impeller is 17 mm-19 mm.

In any of the above-described technical solutions, a perpendicular foot of the center of the cross-flow impeller on the surface of the first heat exchange section is adjacent to the other end of the first heat exchange section.

The other end of the first heat exchange section is construed relative to the end of the first heat exchange section adjacent to the volute tongue plate, and can be construed as the other end of the first heat exchange section being the end of the first heat exchange section away from the volute tongue plate.

The arrangement that the perpendicular foot of the center of the cross-flow impeller on the surface of the first heat exchange section is adjacent to the other end of the first heat exchange section can also be construed as the perpendicular foot of the center of the cross-flow impeller on the surface of the first heat exchange section being located at a position between a midpoint of the first heat exchange section and the other end of the first heat exchange section. Since the position of the perpendicular foot of the center of the cross-flow impeller on the surface of the first heat exchange section is the point on the first heat exchange section having the smallest distance to the cross-flow impeller, the wind force and the air volume at this position are both larger than any other position of the first heat exchange section. For the multi-section structure, the position between two adjacent sections is generally the refrigerant inlet position. By designing the position of the perpendicular foot to be adjacent to the other end of the first heat exchange section, it is possible to make the heat load of the heat exchanger more adapted to the wind force at the corresponding position, and improve the heat exchange energy efficiency.

In any of the above-described technical solutions, another section of the multi-section structure is a second heat exchange section, one end of the second heat exchange section is adjacent to the first heat exchange section, and the vertical distance between a surface of the second heat exchange section and the outer surface of the cross-flow impeller is 19 mm-25 mm.

In this way, it is possible to prevent the distance between the second heat exchange section and the outer surface of the cross-flow impeller from being too small, thereby preventing the generation of an airflow vortex at the second heat exchange section and at a portion of the cross-flow impeller adjacent to the second heat exchange section, making it possible to avoid an airflow vortex at the positions and the problem of noise superposition at the volute tongue plate and the first heat exchange section, reduce the airflow noise during the operation of the equipment, and reduce the energy loss of the airflow. Moreover, it is also possible to prevent the distance between the first heat exchange section and the outer surface of the cross-flow impeller from being too large, thereby making it possible to prevent the problem of turbulent flow caused by an excessively large difference in flow velocity between the airflow at the surface of the volute tongue plate and the airflow at the position of the first heat exchange section adjacent to the position of the volute tongue plate and at the position of the cross-flow impeller, which is also more conducive to reducing the size of the equipment, and ensures that there is no reduction or loss in air pressure and air volume of the cross-flow impeller, so as to ensure the operation efficiency of the cross-flow impeller.

In the above-described technical solution, a perpendicular foot of the center of the cross-flow impeller on the second heat exchange section is adjacent to the one end of the second heat exchange section.

The one end of the second heat exchange section is the end of the second heat exchange section adjacent to the first heat exchange section.

The arrangement that the perpendicular foot of the center of the cross-flow impeller on the surface of the second heat exchange section is adjacent to the one end of the second heat exchange section can also be construed as the perpendicular foot of the center of the cross-flow impeller on the surface of the second heat exchange section being located at a position between a midpoint of the second heat exchange section and the one end of the second heat exchange section. Since the position of the perpendicular foot of the center of the cross-flow impeller on the surface of the second heat exchange section is the point on the second heat exchange section having the smallest distance to the cross-flow impeller, the wind force and the air volume at this position are both larger than any other position of the second heat exchange section. For the multi-section structure, the position between two adjacent sections is generally the refrigerant inlet position. By designing the position of the perpendicular foot to be adjacent to the one end of the second heat exchange section, it is possible to make the heat load of the heat exchanger more adapted to the wind force at the corresponding position, and improve the heat exchange energy efficiency.

In any of the above-described technical solutions, the heat exchanger has a two-section structure or a three-section structure.

In any of the above-described technical solutions, the heat exchanger is an indoor-side heat exchanger of the window air conditioner, and the cross-flow impeller is an indoor-side impeller of the window air conditioner.

In any of the above-described technical solutions, the window air conditioner further comprises a heat exchanger, and the heat exchanger comprises: a first heat exchange section; a second heat exchange section; a fixation frame, which has a two-section structure and comprises a first fixation section and a second fixation section, an angle between the first fixation section and the second fixation section being 118°-145°, the first heat exchange section being connected to the first fixation section, the second heat exchange section being connected to the second fixation section, and an angle between the first heat exchange section and the second heat exchange section being the same as the angle between the first fixation section and the second fixation section.

The fixation frame is provided with a first fixation section and a second fixation section to fix the first heat exchange section and the second heat exchange section, respectively, such that the angle between the first heat exchange section fixed by the first fixation section and the second heat exchange section fixed by the second fixation section is equal to the angle between the first fixation section and the second fixation section, which achieves a good shaping effect on the heat exchanger and enables convenient assembly, wherein by setting the angle between the first fixation section and the second fixation section to be 118°-145°, the angle between the first heat exchange section and the second heat exchange section assembled and constructed by the first fixation section and the second fixation section can be 118°-145°. In this way, the objects of reducing the space occupation rate of the heat exchanger and reducing the overall machine size can be achieved, the whole fixation frame has relatively uniform internal stress distribution, has good bearing effect, and is not easy to deform, and the load received by the first heat exchange section and the second heat exchange section is relatively small. Moreover, when the heat exchanger is in the range of the angle of 118°-145°, the airflow at the heat exchanger has a smoother flow line than in the case of any other configuration, the airflow noise is small, the loss in air pressure and air volume is small, and the energy efficiency attenuation is not obvious, which achieves the comprehensive object of giving consideration to product size, operation noise and energy efficiency, and solves the problem in the existing window air conditioner that it is difficult to give consideration to both the equipment size and the performance parameters such as product noise and energy efficiency.

In the above-described technical solution, the angle between the first fixation section and the second fixation section is 130.5°-140.5°.

The angle between the first fixation section and the second fixation section is further designed to be 130.5°-140.5°, so that the angle between the first heat exchange section and the second heat exchange section is correspondingly 130.5°-140.5°. In this way, the objects of reducing the space occupation rate of the heat exchanger and reducing the overall machine size can be achieved, and when the heat exchanger is in the range of the angle of 130.5°-140.5°, the smoothness of the flow line of the airflow at the heat exchanger is further improved, the airflow noise is smaller, the loss in air pressure and air volume is further reduced, and the energy efficiency attenuation is not obvious, thereby achieving the comprehensive object of giving consideration to product size, operation noise and energy efficiency.

In some embodiments, the angle between the first fixation section and the second fixation section is 133.5°-147.5°. In some embodiments, the angle between the first fixation section and the second fixation section is 135.5°.

In any of the above-described technical solutions, the first heat exchange section and the second heat exchange section are each provided with a plurality of heat exchange tubes, the first fixation section is provided with first tube holes configured to avoid the heat exchange tubes of the first heat exchange section, and the second fixation section is provided with second tube holes configured to avoid the heat exchange tubes of the second heat exchange section.

The first heat exchange section and the first fixation section, and the second heat exchange section and the second fixation section may be positioned and limited by a nested structure formed between the first tube holes and the second tube holes and the heat exchange tubes, to ensure that the angle between the first fixation section and the second fixation section is the same as the angle between the first heat exchange section and the second heat exchange section, thereby improving the accuracy of shaping of the first heat exchange section and the second heat exchange section.

In the above-described technical solution, the first tube holes are arranged in two rows or in three rows.

In the case where the angle between the first fixation section and the second fixation section is 118°-145°, i.e., in the case where the angle between the first heat exchange section and the second heat exchange section is 118°-145°, by arranging the first tube holes in two rows or in three rows, it is possible to further improve the smoothness of the flow line of the airflow at the first fixation section, achieve the objects of reducing noise, reducing the loss in air pressure and reducing the loss in air volume, and effectively ensure the heat exchange efficiency of the heat exchanger, so as to realize comprehensive improvement of the energy efficiency of the equipment.

In any of the above-described technical solutions, the second tube holes are arranged in two rows or in three rows.

In the case where the angle between the first fixation section and the second fixation section is 118°-145°, i.e., in the case where the angle between the first heat exchange section and the second heat exchange section is 118°-145°, by arranging the second tube holes in two rows or in three rows, it is possible to further improve the smoothness of the flow line of the airflow at the second fixation section, achieve the objects of reducing noise, reducing the loss in air pressure and reducing the loss in air volume, and effectively ensure the heat exchange efficiency of the heat exchanger, so as to realize comprehensive improvement of the energy efficiency of the equipment.

In any of the above-described technical solutions, the sum of the number of first tube holes and the number of second tube holes is 12-15.

In the case where the angle between the first fixation section and the second fixation section is 118°-145°, i.e., in the case where the angle between the first heat exchange section and the second heat exchange section is 118°-145°, by setting the sum of the number of first tube holes and the number of second tube holes to be 12-15, it is possible to further improve the smoothness of the flow line of the airflow at the second fixation section, achieve the objects of reducing noise, reducing the loss in air pressure and reducing the loss in air volume, and effectively ensure the heat exchange efficiency of the heat exchanger, so as to realize comprehensive improvement of the energy efficiency of the equipment.

In any of the above-described technical solutions, the fixation frame is provided with a mounting structure for mounting and fixing the fixation frame.

By providing a mounting structure on the fixation frame for the assembly of the fixation frame with other components of the air conditioner, the assembly accuracy and efficiency between the heat exchanger and other devices of the air conditioner can be improved.

In any of the above-described technical solutions, the base is provided with a bracket integrally formed with the base, the bracket is provided with a fixation structure configured to fix the heat exchanger, the base is provided with a water receiving groove integrally molded with the base, and the water receiving groove is configured to receive water from the heat exchanger.

The base is integrally molded with the bracket and the water receiving groove. On the one hand, the number of parts of the window air conditioner can be reduced, which not only facilitates the production of the window air conditioner, but also facilitates improving the assembly efficiency of the window air conditioner, and in this solution, there is no need to mount and position the water receiving groove, the base and the bracket, and the assembly and positioning of the heat exchanger and the water receiving groove can be achieved simultaneously when the heat exchanger is mounted on the bracket, which is more conducive to ensuring the assembly accuracy between the heat exchanger and the water receiving groove, and prevents the problem of water leakage caused by deviation of the heat exchanger or the water receiving groove. On the other hand, the integrally formed base, water receiving groove and bracket have relatively high connection strength, and are less likely to be deformed or even broken, which leads to relatively high reliability of overall connection between the base and the relevant structures of the window air conditioner connected to the base. In this way, it is possible to solve the problems of complex assembly process and relatively low assembly efficiency caused by separate connection of the fixation member of the heat exchanger, the water receiving groove and the base in the existing window air conditioner, and solve the problem of poor reliability of the overall connection of the heat exchanger, the fixation member of the heat exchanger, the water receiving groove and the base, resulting from the influence of manufacturing precision and human factors in the existing window air conditioner.

In the above-described technical solution, the bracket comprises: two supporting plates configured to support the heat exchanger, the two supporting plates being spaced apart from each other, and plate edges of the two supporting plates that are used for supporting the heat exchanger being configured to be inclined shape; and a rear abutment plate located at one side of the two supporting plates; the heat exchanger being located at the bracket, the portion of the heat exchanger supported by the supporting plates having an inclined shape adapted to the plate edges, and a bottom end portion of the heat exchanger abutting against the rear abutment plate.

The two supporting plates of the bracket are spaced apart from each other and support the heat exchanger, wherein the portions of the supporting plates that are used for supporting the heat exchanger are configured to have an inclined shape, and the portions of the heat exchanger that are supported by the supporting plates are made to have an inclined shape adapted to the plate edge, so as to facilitate the condensed water on the heat exchanger dripping from the heat exchanger smoothly, to reduce the possibility of accumulation of the condensed water on the surface of the heat exchanger, thereby reducing the influence of the condensed water on the heat exchange performance of the heat exchanger and improving the stability of the heat exchange performance of the heat exchanger. Moreover, by making the bottom end portion of the heat exchanger abut against the rear abutment plate, the rear abutment plate can limit the displacement of the heat exchanger towards one side of the rear abutment plate, which improves the reliability of the connection between the heat exchanger and the base.

In the above-described technical solution, the spacing between the two supporting plates is adapted to the width of the heat exchanger such that the supporting position at which the supporting plates support the heat exchanger is adjacent to a side plate of the heat exchanger.

In this way, the influence of the two supporting plates on the air intake of the heat exchanger can be reduced, that is, the wind resistance of the supporting plates during the air intaking process of the heat exchanger can be reduced, which facilitates improving the air intaking efficiency of the heat exchanger and further improves the heat exchange performance of the heat exchanger.

In the above-described technical solution, the two supporting plates are located between two side plates of the heat exchanger, and the two side plates of the heat exchanger clamp the two supporting plates towards each other.

In this way, on the one hand, the reliability of the connection between the heat exchanger and the two supporting plates can be improved, and on the other hand, the displacement of the heat exchanger in the width direction can be restricted by the abutment between the supporting plates and the two side plates, thereby further improving the reliability of the connection between the heat exchanger and the two supporting plates.

In any of the above-described technical solutions, the supporting plates are provided with reinforcing ribs.

In this way, the strength of the supporting plates can be improved, thereby improving the reliability of the connection between the heat exchanger and the base.

In any of the above-described technical solutions, the rear abutment plate is provided with reinforcing ribs.

In this way, the strength of the rear abutment plate can be improved to reduce the possibility of the heat exchanger moving towards one side of the rear abutment plate and improve the reliability of the connection between the heat exchanger and the base.

Moreover, in the case where the supporting plates and the rear abutment plate are each provided with reinforcing ribs, the reliability of the connection between the heat exchanger and the base can be greatly improved.

In any of the above-described technical solutions, the fixation structure comprises a screw hole structure, the heat exchanger is provided with a through hole corresponding to the screw hole structure, and a threaded fastener is passed through the through hole and threadedly connected to the screw hole structure.

At the time of mounting the heat exchanger, after the positioning of the heat exchanger is completed, the threaded fastener is passed through the through hole on the heat exchanger and threadedly connected to the screw hole structure, so as to realize fixed connection between the heat exchanger and the bracket. The use of the screw hole structure and the threaded fastener leads to a simple structure and convenient assembly and disassembly, and facilitates improving the assembly speed of the heat exchanger and the base, and also ensures reliable connection, so as to improve the reliability of connection between the bracket and the heat exchanger.

In any of the above-described technical solutions, the bracket is provided with the first fixation member.

The filter is fixedly connected with the bracket by the first fixation member, and can filter the impurities in a fluid flowing into the heat exchanger to reduce the impurities in the heat exchanger, thereby reducing the influence of the impurities on the heat exchange performance of the heat exchanger, and improving the stability of the heat exchange performance of the heat exchanger. Moreover, the filter and the heat exchanger are both fixedly disposed on the bracket, so that the filter, the base and the heat exchanger are more accurately positioned, and have higher reliability of overall connection.

In any of the above-described technical solutions, the base is an indoor-side base of the window air conditioner, the base is provided with a water discharge opening for discharging water to the outdoor side of the window air conditioner, and the water discharge opening communicates with the water receiving groove.

The base is an indoor-side base, and after the water receiving groove on the base collects the condensed water from the heat exchanger, the condensed water flows through the water discharge opening communicating with the water receiving groove and flows to the outdoor side of the window air conditioner, which can reduce the influence of the condensed water generated by the heat exchanger on the indoor-side user.

Additional aspects and advantages of the present disclosure will become apparent in the following description, or are understood by the practice of the present disclosure.

BRIEF DESCRIPTION OF THE DRAWINGS

The above and/or additional aspects and advantages of the present disclosure will become apparent and readily understood from the following description of embodiments in conjunction with the drawings.

Figure 1:
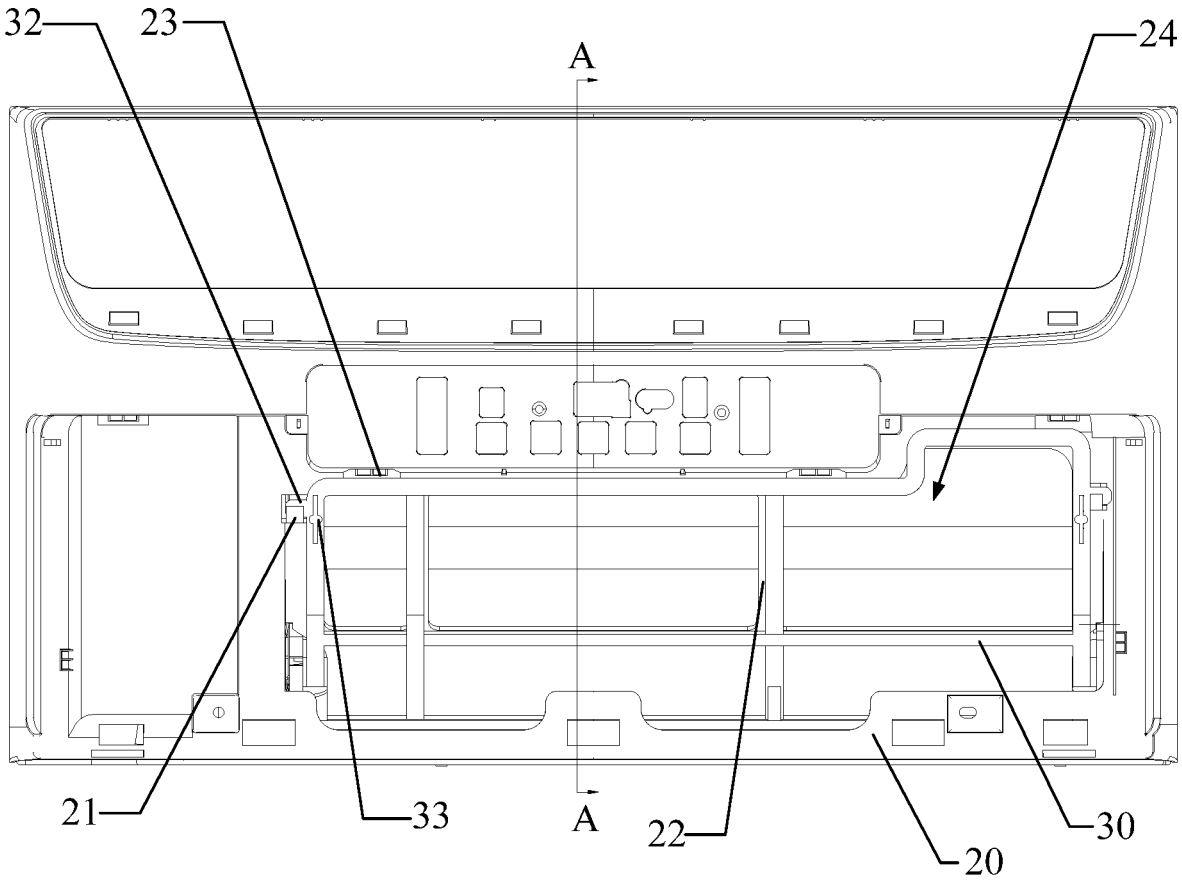
FIG. 1 is a schematic partial front view of a window air conditioner according to an embodiment of the present disclosure.

The corresponding relationship between the reference numerals and components in FIG. 1 to FIG. 15 are as follows:

10 base, 11 guide rail groove, 12 first supporting rib, 13 supporting plate, 14 rear abutment plate, 15 reinforcing rib, 17 water receiving groove, 18 water discharge opening, 19 screw hole structure, 20 front panel, 21 locking groove, 22 second supporting rib, 23 stopping member, 24 air inlet, 30 filter, 31 track, 32 convex rib, 33 clasp, 40 heat exchanger, 41 first heat exchange section, 42 second heat exchange section, 43 through hole, 50 cross-flow impeller, 61 volute tongue plate, 62 volute plate, 63 volute assembly, 70 fixation frame, 71 first fixation section, 711 first tube hole, 72 second fixation section, 721 second tube hole, 731 first connection edge, 732 second connection edge, and 74 threaded hole.

DETAILED DESCRIPTION OF THE EMBODIMENTS

In order that the above-mentioned objectives, features and advantages of the present disclosure can be understood more clearly, a further detailed description of the present disclosure will be given below in connection with the accompanying drawings and specific embodiments. The embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

A window air conditioner according to some embodiments of the present disclosure is described below with reference to FIG. 1 to FIG. 15.

As shown in FIG. 1 to FIG. 4, the window air conditioner provided by an embodiment of the present disclosure comprises: a base 10, a front panel 20 and a filter 30.

Specifically, the base 10 is provided with a first fixation member; the front panel 20 is provided with a second fixation member; and one end 301 of the filter 30 is detachably connected to the first fixation member, and the other end 302 of the filter 30 is detachably connected to the second fixation member, wherein a supporting member is arranged on the base 10 and/or the front panel 20, and the supporting member abuts against the filter 30, so that the filter 30 is configured to be in an arc shape.

In the window air conditioner provided by the above-mentioned embodiment of the present disclosure, the filter 30 is fixed by the first fixation member and the second fixation member, and a supporting member is provided to support the filter 30, so that the filter 30 is elastically deformed after being fixed and configured into an arc shape. Compared with the structure in which the filter 30 is laid flat at the air inlet 24, the arc-shaped filter 30 structure has a larger filtering area, can improve the filtering efficiency, and has reduced resistance loss when an airflow comes into contact with a surface of the arc-shaped filter 30, thereby reducing the losses of air pressure and air volume, improving the energy efficiency of the equipment, and reducing the noise of the airflow at the filter 30. In addition, the arc-shaped filter 30 can realize multi-angle inlet air filtration, and in the case of multi-direction air intake of the equipment, it is only needed to adjust the arc radian and bending direction to adapt to the air intake angle, without the need to provide a plurality of filters 30 for filtering separately, which reduces the number of filters 30, while meeting the filtering need, and saves the work involved in mounting and dismounting of the filter 30 and facilitates the daily cleaning of products. Moreover, by connecting the filter 30 to the second fixation member on the front panel 20, the user can integrally take the filter 30 out from the position of the front panel 20 for cleaning, which makes it more convenient for the user to take the filter out and improves the use experience of the product.

Figure 3:
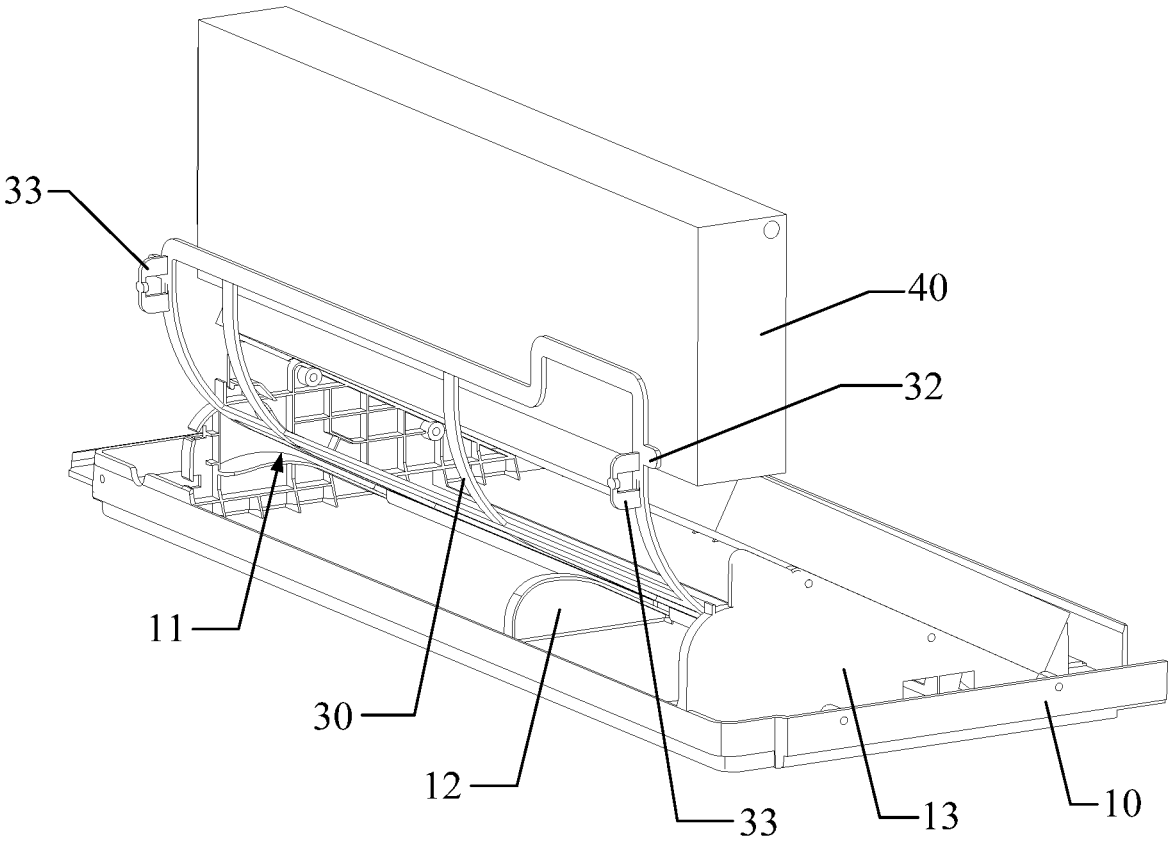
FIG. 3 is a schematic partial perspective view of the window air conditioner according to an embodiment of the present disclosure.
Figure 4:
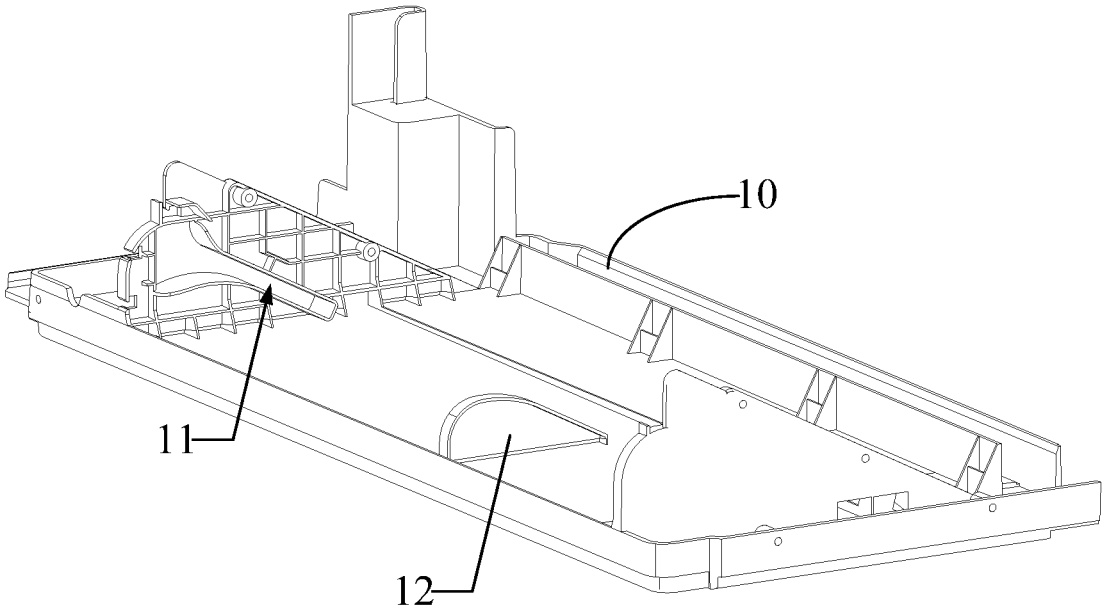
FIG. 4 is a schematic perspective view of a base according to an embodiment of the present disclosure.

In a specific embodiment of the present disclosure, as shown in FIG. 3 and FIG. 4, one of the first fixation member and the second fixation member is a guide rail groove 11, and the track 31 is a guide rail that can be slidably fitted with the guide rail groove 11, wherein when the filter 30 is slidably connected to the guide rail groove 11, the filter 30 is shaped, by the guide rail groove 11, to be adapted to a track shape of the guide rail groove 11. The structure is simple, realizes operation ease and convenience of assembly and disassembly between the filter 30 and the base 10 or the front panel 20, and facilitates daily cleaning of the filter 30 by the user. Moreover, by making use of the characteristic that while the filter 30 is slidably assembled by means of the guide rail groove 11, the guide rail groove 11 is adapted to and matched with the track 31, the guide rail groove 11 can be used to support and shape the filter 30, in order to assist in configuring the filter 30 into an arc shape, thereby enabling the filter 30 to be more stably kept in an arc shape, and preventing spring back of the filter 30.

In the present embodiment, as shown in FIG. 4, the track shape of the guide rail groove 11 is oblique line-shaped or arc-shaped. While assisting in configuring the filter 30 into an arc shape, this structure can facilitate the processing and manufacturing of the product due to its simple shape, is more conducive to ensuring smooth sliding of the track 31 of the filter 30 in the guide rail groove 11, and facilitates daily disassembly and cleaning of the filter 30 by the user.

In the present embodiment, as shown in FIG. 4, an entrance of the guide rail groove 11 is configured to have a trumpet shape. This can facilitate the insertion of the track 31 of the filter 30 along the entrance of the guide rail groove 11, thereby facilitating daily assembly, disassembly and cleaning of the filter 30 by the user.

In the present embodiment, as shown in FIG. 4, a surface of the entrance of the guide rail groove 11 is an arc surface. It can be understood that since the guide rail groove 11 has certain shaping and supporting effect on the filter 30, there is an internal stress transition between a state of being shaped by the guide rail groove 11 and a state of not being shaped by the guide rail groove 11 in a portion of the filter 30 in the vicinity of the entrance of the guide rail groove 11. In this design, the surface at the entrance of the guide rail groove 11 is configured to be an arc surface, which can help the filter 30 to adapt to the change of its internal stress in shape to form an appropriate bending shape transition, and prevent the filter 30 from being broken due to an excessively large bending angle. Moreover, the arc-shaped surface leads to small friction and wear when coming into contact with the filter 30, which can avoid the problem of scratching of the filter 30 by the guide rail groove 11 and ensure the product quality.

In other embodiments, one of the first fixation member and the second fixation member is a guide rail, then the track 31 is a guide rail groove that can be slidably fitted with the guide rail, wherein when the filter 30 is slidably connected to the guide rail, the filter 30 is shaped, by the guide rail, to be adapted to a track shape of the guide rail. Correspondingly, the track shape of the guide rail may be further configured to be oblique line-shaped or arc-shaped.

In a specific embodiment of the present disclosure, as shown in FIG. 3, the filter 30 is provided with two tracks 31 that are spaced apart from each other, wherein the supporting member comprises a first supporting rib 12, specifically as shown in FIG. 1 to FIG. 4, the first supporting rib 12 is provided at a position of the base 10 between two guide rail grooves 11, and a portion of the filter 30 located between the two tracks 31 is supported by the first supporting rib 12. Slidably connecting the two tracks 31 of the filter 30 with two guide rail grooves 11 or guide rails respectively can enable the filter 30 to slide more smoothly along the guide rail grooves 11 or the guide rails, and providing the first supporting rib 12 to support and shape the filter 30 can prevent a portion of the filter 30 that is not supported or reinforced by the guide rail groove 11 or the guide rail from collapsing and deforming, thereby effectively ensuring that the filtering area of the filter 30 is not reduced, and ensuring the operation energy efficiency of the equipment.

In a specific embodiment of the present disclosure, as shown in FIG. 1, one of the first fixation member and the second fixation member is a guide rail groove 11 or a guide rail, the other one of the first fixation member and the second fixation member comprises a locking groove 21, the filter 30 is provided with a convex rib 32 corresponding to the locking groove 21, and the convex rib 32 can be snapped into the locking groove 21 so as to fix the filter 30. In this solution, by snapping the convex rib 32 of the filter 30 into the locking groove 21, the filter 30 is detachably fixed, that is, unlocking can be realized just by digging the convex rib 32 out from the locking groove 21 at the time of cleaning, which has the advantages of simple structure and convenient use and operation.

Figure 2:
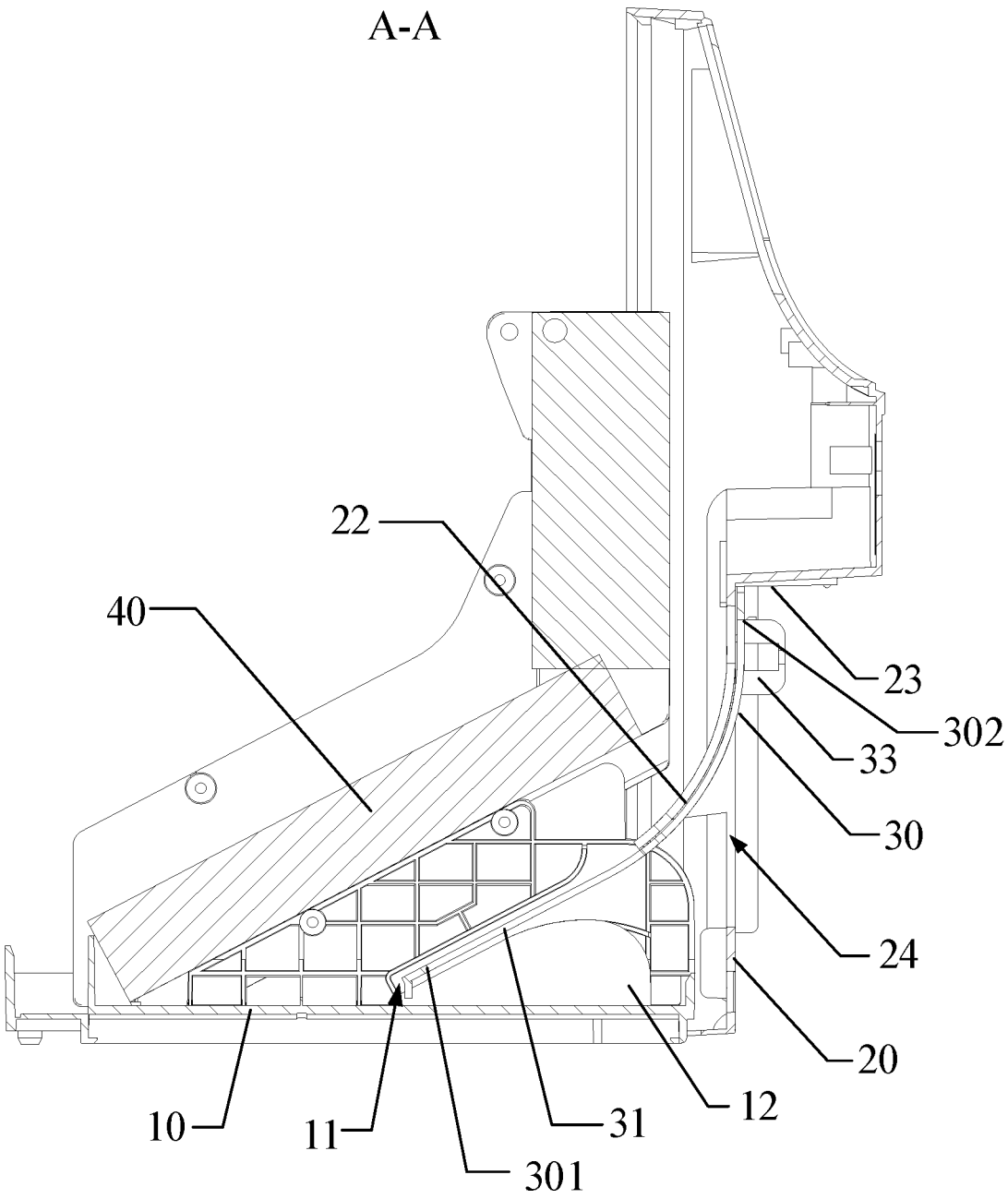
FIG. 2 is a schematic sectional view in the A-A direction shown in FIG. 1.

In the present embodiment, as shown in FIG. 1 and FIG. 2, the other one of the first fixation member and the second fixation member further comprises a stopping member 23 located at a groove opening of the locking groove 21 and configured to limit the convex rib 32 in the locking groove 21, so as to fix the filter 30 and prevent the filter 30 from falling off, and ensure that the filter 30 is fixed stably and reliably.

In a specific embodiment of the present disclosure, as shown in FIG. 2, the supporting member further comprises a second supporting rib 22 having an arc shape, and when the convex rib 32 is snapped into the locking groove 21, the filter 30 is pressed against a surface of the second supporting rib 22. In this way, the filter 30 can be prevented from collapsing and deforming, thereby effectively ensuring that the filtering area of the filter 30 is not reduced and ensuring the operation energy efficiency of the equipment.

In some embodiments, one surface of the filter 30 is supported by the first supporting rib 12 and the other surface of the filter 30 is supported by the second supporting rib 22, and in some embodiments, a portion of the filter 30 supported by the first supporting rib 12 is offset from a portion of the filter 30 supported by the second supporting rib 22. In this way, the filter 30 is well supported and shaped, and there are also relatively fewer supported portions of the filter 30, which can reduce the wind resistance on the filter 30.

In a specific embodiment of the present disclosure, as shown in FIG. 1, FIG. 2 and FIG. 3, a clasp 33 is provided at the filter 30, and when the clasp 33 is lifted, the convex rib 32 is disengaged from the locking groove 21, wherein the clasp 33 allows the user to apply a force to unlock the convex rib 32 from locking groove 21, which has the advantages of simple structure and convenient use and operation.

In a specific embodiment of the present disclosure, the front panel 20 and/or the base 10 are/is provided with an air inlet 24. In some embodiments, the air inlet 24 is provided at the front panel 20 and/or the base 10 at a position corresponding to the filter 30, so as to further reduce wind resistance.

In a specific embodiment of the present disclosure, as shown in FIG. 1 to FIG. 3, the window air conditioner further comprises a heat exchanger 40 located at the base 10. In this solution, the first fixation member is designed on the base 10 for assembly and cooperation with the filter 30, so that the heat exchanger 40 and the filter 30 can be positioned with the same reference, which ensures accurate alignment and matching of the filter 30 and the heat exchanger 40. In this way, by accurately placing the filter 30 at an upstream position of the heat exchanger 40, it is possible to effectively filter the airflow upstream of the heat exchanger 40 to prevent dust from contaminating the heat exchanger 40 and avoid the problem of clogging the heat exchanger 40.

In some embodiments, the heat exchanger 40 is a multi-section heat exchanger 40, the filter 30 is located at the upstream side of the heat exchanger 40, and the arc shape of the filter 30 matches the shape of the heat exchanger 40, so that the filter 30 is arranged on the outer side of the heat exchanger 40 in such a manner as to surround half of the heat exchanger 40.

In some embodiments, as shown in FIG. 3, the base 10 is provided with a supporting plate 13 for supporting the heat exchanger 40, and the first fixation member of the base 10 is provided at the supporting plate 13. In this structure, by arranging the first fixation member and the second fixation member used for fixing and shaping the filter 30 to two separate components, respectively, i.e., the first fixation member being located at the base 10 and the second fixation member being located at the front panel 20, compared with the solution in which the first fixation member and the second fixation member are integrated on a single component, there is no need to consider the continuity of the two fixation members, in this way, the processing technology of the components can be simplified, especially for injection molded components, the mold structure and injection molding process are greatly simplified, which is beneficial to improving the molding quality of products.

Figure 5:
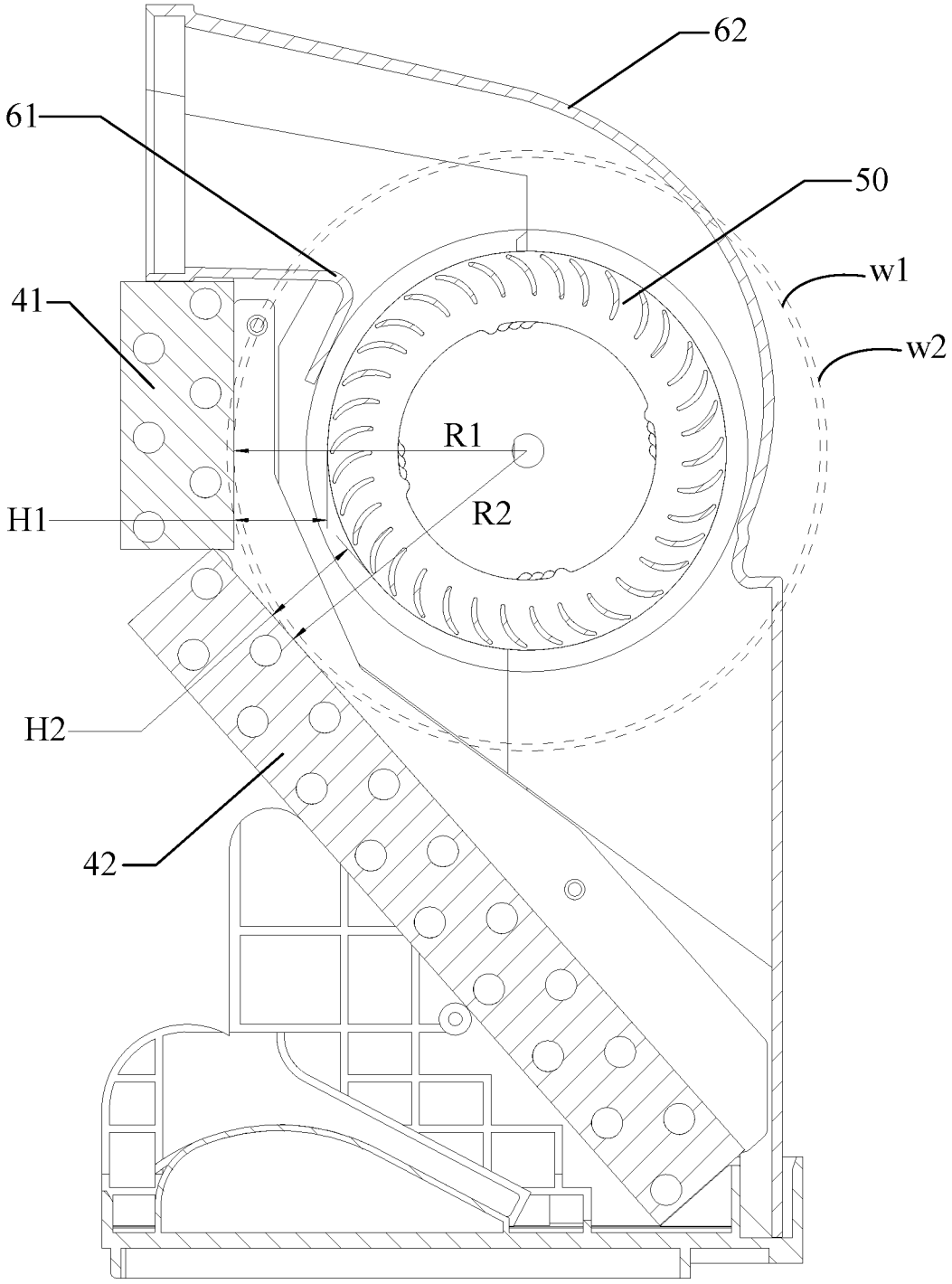
FIG. 5 is a schematic sectional view of the window air conditioner according to an embodiment of the present disclosure.
Figure 6:
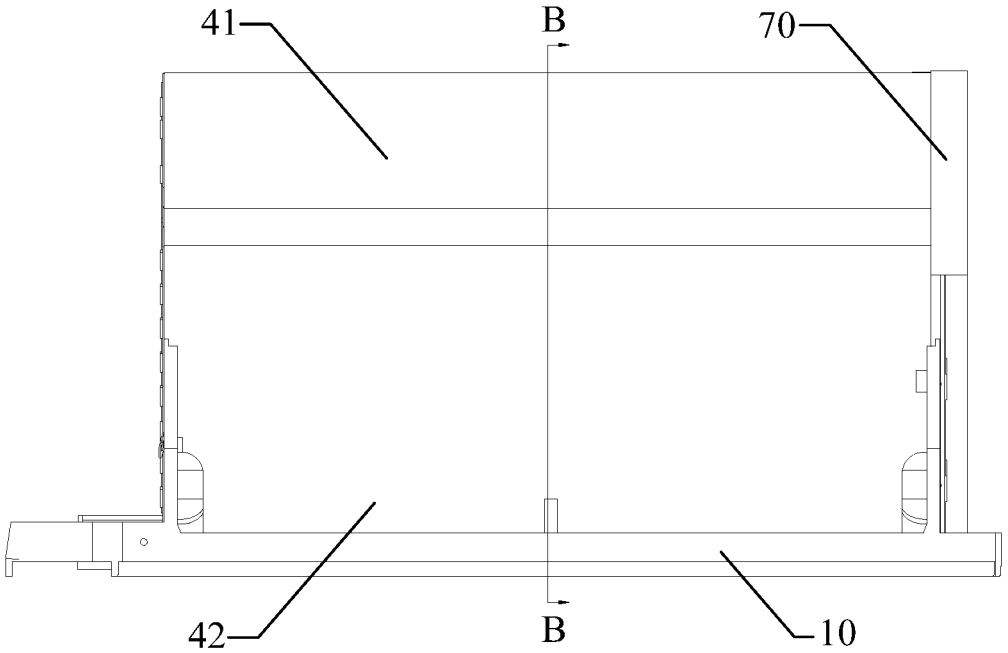
FIG. 6 is a schematic partial front view of the window air conditioner according to an embodiment of the present disclosure.

FIG. 5 shows the window air conditioner provided by an embodiment of the present disclosure. The window air conditioner comprises a cross-flow impeller 50 and a heat exchanger 40. Specifically, the heat exchanger 40 is adjacent to the cross-flow impeller 50, and the vertical distance between a surface of the heat exchanger 40 and an outer surface of the cross-flow impeller 50 is 14 mm-25 mm.

In the window air conditioner according to the above embodiment of the present disclosure, the vertical distance between the surface of the heat exchanger 40 and the outer surface of the cross-flow impeller 50 is set to be 14 mm-25 mm (e.g., the vertical distance between the surface of the heat exchanger 40 and the outer surface of the cross-flow impeller 50 is designed to be any of 16 mm, 17 mm, 18.5 mm, 19.5 mm, 20 mm, 21 mm, 22 mm, 23 mm, etc.), wherein by controlling the vertical distance between the surface of the heat exchanger 40 and the outer surface of the cross-flow impeller 50 to be greater than or equal to 14 mm, the airflow noise during the operation of the equipment can be reduced, and by controlling the vertical distance between the surface of the heat exchanger 40 and the outer surface of the cross-flow impeller 50 to be smaller than or equal to 25 mm, the size of the equipment can be reduced, it can be effectively ensured that there is no reduction or loss in the air pressure and air volume of the cross-flow impeller 50, and the operation efficiency of the cross-flow impeller 50 can be ensured.

In the present embodiment, as shown in FIG. 5, the heat exchanger 40 has a multi-section structure, and an angle is formed between any two adjacent sections of the multi-section structure, so that the heat exchanger 40 is recessed as a whole, wherein the cross-flow impeller 50 is located at one side of the heat exchanger 40 that is inwardly recessed. By designing the heat exchanger 40 as a multi-section structure and arranging the heat exchanger 40 on the outer side of the cross-flow impeller 50 in such a manner as to surround half of the cross-flow impeller 50, simple structure is achieved and multi-angle air intake and heat exchange can be realized, which improves effective heat exchange area and heat exchange efficiency of the heat exchanger 40, and is also more conducive to reducing the size of the equipment, and ensures that the cross-flow impeller 50 will experience no reduction or loss in air pressure and air volume, so as to ensure the operation efficiency of the cross-flow impeller 50.

In the present embodiment, as shown in FIG. 5, the window air conditioner further comprises a volute tongue plate 61 and a volute plate 62, the volute tongue plate 61 and the volute plate 62 form a volute air duct, wherein one section of the multi-section structure is a first heat exchange section 41, one end of the first heat exchange section 41 is adjacent to the volute tongue plate. More specifically, as shown in FIG. 5, the one end of the first heat exchange section 41 is embedded in a position on the leeward side of the volute tongue plate. In addition, the vertical distance H1 between the surface of the first heat exchange section 41 and the outer surface of the cross-flow impeller 50 is 14 mm-25 mm.

FIG. 5 shows an auxiliary circle w1 with the center of the cross-flow impeller 50 as the circle center and tangent to the surface of the first heat exchange section 41. The difference between the radius R1 of the auxiliary circle w1 and the outer contour radius R of the cross-flow impeller 50 is H1, that is, the difference between the radius R1 of the auxiliary circle w1 and the outer contour radius R of the cross-flow impeller 50 is the vertical distance between the surface of the first heat exchange section 41 and the outer surface of the cross-flow impeller 50.

In this solution, the first heat exchange section 41 is adjacent to the volute tongue plate 61, and the vertical distance H1 between the surface of the first heat exchange section 41 and the outer surface of the cross-flow impeller 50 is designed to be 14 mm-25 mm. In this way, it is possible to prevent the distance between the first heat exchange section 41 and the outer surface of the cross-flow impeller 50 from being too small, making it possible to prevent the generation of an airflow vortex at the first heat exchange section 41 and at a portion of the cross-flow impeller 50 adjacent to the first heat exchange section 41, thereby avoiding the problem of noise superposition at the volute tongue plate 61 and reducing the energy loss of the airflow. Moreover, it is also possible to prevent the distance between the first heat exchange section 41 and the outer surface of the cross-flow impeller 50 from being too large, thereby making it possible to prevent the problem of turbulent flow caused by an excessively large difference in flow velocity between the airflow at the surface of the volute tongue plate 61 and the airflow at the position of the first heat exchange section 41 adjacent to the position of the volute tongue plate 61 and at the position of the cross-flow impeller 50, which is also more conducive in reducing the size of the equipment, and ensures that there is no reduction or loss in air pressure and air volume of the cross-flow impeller 50, so as to ensure the operation efficiency of the cross-flow impeller 50.

In some embodiments, as shown in FIG. 5, the vertical distance H1 between the surface of the first heat exchange section 41 and the outer surface of the cross-flow impeller 50 is 14 mm-22 mm. In this way, it is possible to further prevent the distance between the first heat exchange section 41 and the outer surface of the cross-flow impeller 50 from being too large, thereby preventing the problem of turbulent flow caused by an excessively large difference in flow velocity between the airflow at the surface of the volute tongue plate 61 and the airflow at the position of the first heat exchange section 41 adjacent to the position of the volute tongue plate 61 and at the position of the cross-flow impeller 50, which is also more conducive to reducing the size of the equipment, and ensures that there is no reduction or loss in air pressure and air volume of the cross-flow impeller 50, so as to ensure the operation efficiency of the cross-flow impeller 50.

In some embodiments, the vertical distance between the surface of the first heat exchange section 41 and the outer surface of the cross-flow impeller 50 is 17 mm-19 mm.

In this embodiment, as shown in FIG. 5, a perpendicular foot of the center of the cross-flow impeller 50 on the surface of the first heat exchange section 41 is adjacent to the other end of the first heat exchange section 41.

The other end of the first heat exchange section 41 is construed relative to the end of the first heat exchange section 41 adjacent to the volute tongue plate 61, and can be construed as the other end of the first heat exchange section 41 being the end of the first heat exchange section 41 away from the volute tongue plate 61.

In this solution, the perpendicular foot of the center of the cross-flow impeller 50 on the surface of the first heat exchange section 41 is adjacent to the other end of the first heat exchange section 41. That is, the perpendicular foot of the center of the cross-flow impeller 50 on the surface of the first heat exchange section 41 is located at a position between a midpoint of the first heat exchange section 41 and the other end of the first heat exchange section 41. Since the position of the perpendicular foot of the center of the cross-flow impeller 50 on the surface of the first heat exchange section 41 is the point on the first heat exchange section 41 having the smallest distance to the cross-flow impeller 50, the wind force and the air volume at this position are both larger than any other position of the first heat exchange section 41. For the multi-section structure, the position between two adjacent sections is generally the refrigerant inlet position. By designing the position of the perpendicular foot to be adjacent to the other end of the first heat exchange section 41, it is possible to make the heat load of the heat exchanger 40 more adapted to the wind force at the corresponding position, and improve the heat exchange energy efficiency.

In this embodiment, as shown in FIG. 5, another section of the multi-section structure is a second heat exchange section 42, one end of the second heat exchange section 42 is adjacent to the first heat exchange section 41, and the vertical distance H2 between a surface of the second heat exchange section 42 and the outer surface of the cross-flow impeller 50 is 19 mm-25 mm.

FIG. 5 also shows another auxiliary circle w2 with the center of the cross-flow impeller 50 as the circle center, and tangent to the surface of the second heat exchange section 42. The difference between the radius R2 of the auxiliary circle w2 and the outer contour radius R of the cross-flow impeller 50 is H2, that is, the difference between the radius R2 of the auxiliary circle w2 and the outer contour radius R of the cross-flow impeller 50 is the vertical distance between the surface of the second heat exchange section 42 and the outer surface of the cross-flow impeller 50.

In this solution, the vertical distance H2 between the surface of the second heat exchange section 42 and the outer surface of the cross-flow impeller 50 is designed to be 19 mm-25 mm. In this way, it is possible to prevent the distance between the second heat exchange section 42 and the outer surface of the cross-flow impeller 50 from being too small, thereby preventing the generation of an airflow vortex at the second heat exchange section 42 and at a portion of the cross-flow impeller 50 adjacent to the second heat exchange section 42, making it possible to avoid an airflow vortex at the positions and the problem of noise superposition at the volute tongue plate 61 and the first heat exchange section 41, reduce the airflow noise during the operation of the equipment, and reduce the energy loss of the airflow. Moreover, it is also possible to prevent the distance between the first heat exchange section 41 and the outer surface of the cross-flow impeller 50 from being too large, thereby making it possible to prevent the problem of turbulent flow caused by an excessively large difference in flow velocity between the airflow at the surface of the volute tongue plate 61 and the airflow at the position of the first heat exchange section 41 adjacent to the position of the volute tongue plate 61 and at the position of the cross-flow impeller 50, which is also more conducive to reducing the size of the equipment, and ensures that there is no reduction or loss in air pressure and air volume of the cross-flow impeller 50, so as to ensure the operation efficiency of the cross-flow impeller 50.

In this embodiment, as shown in FIG. 5, a perpendicular foot of the center of the cross-flow impeller 50 on the second heat exchange section 42 is adjacent to the one end of the second heat exchange section 42.

The one end of the second heat exchange section 42 is the end of the second heat exchange section 42 adjacent to the first heat exchange section 41.

In this solution, the perpendicular foot of the center of the cross-flow impeller 50 on the surface of the second heat exchange section 42 is adjacent to the one end of the second heat exchange section 42. That is, the perpendicular foot of the center of the cross-flow impeller 50 on the surface of the second heat exchange section 42 is located at a position between a midpoint of the second heat exchange section 42 and the one end of the second heat exchange section 42. Since the position of the perpendicular foot of the center of the cross-flow impeller 50 on the surface of the second heat exchange section 42 is the point on the second heat exchange section 42 having the smallest distance to the cross-flow impeller 50, the wind force and the air volume at this position are both larger than any other position of the second heat exchange section 42. For the multi-section structure, the position between two adjacent sections is generally the refrigerant inlet position. By designing the position of the perpendicular foot to be adjacent to the one end of the second heat exchange section 42, it is possible to make the heat load of the heat exchanger 40 more adapted to the wind force at the corresponding position, and improve the heat exchange energy efficiency.

Optionally, the heat exchanger 40 has a two-section structure or a three-section structure.

Optionally, the heat exchanger 40 is an indoor-side heat exchanger 40 of the window air conditioner, and the cross-flow impeller 50 is an indoor-side impeller of the window air conditioner.

As shown in FIG. 6 to FIG. 10, the window air conditioner provided by an embodiment of the present disclosure comprises the heat exchanger 40. The heat exchanger 40 specifically comprises the first heat exchange section 41, the second heat exchange section 42 and a fixation frame 70.

Figure 9:
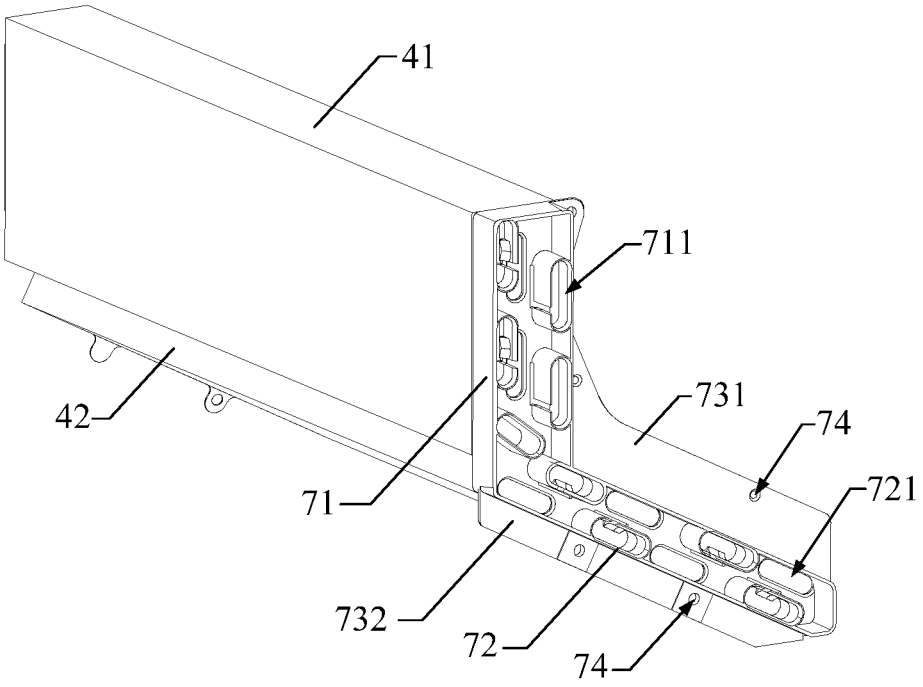
FIG. 9 is a schematic perspective view of a heat exchanger according to an embodiment of the present disclosure.

As shown in FIG. 9, the fixation frame 70 has a two-section structure and specifically comprises a first fixation section 71 for fixing the first heat exchange section 41 and a second fixation section 72 for fixing the second heat exchange section 42, and the angle α between the first fixation section 71 and the second fixation section 72 is 118°-145°.

The first heat exchange section 41 is connected to the first fixation section 71, the second heat exchange section 42 is connected to the second fixation section 72, and the angle between the first heat exchange section 41 and the second heat exchange section 42 is the same as the angle between the first fixation section 71 and the second fixation section 72.

With the fixation frame 70 of the heat exchanger 40 provided by the above embodiment of the present disclosure, the assembled and constructed heat exchanger 40 as a whole is shaped to have an angle of 118°-145°, which achieves a good shaping effect on the heat exchanger 40 and enables convenient assembly. Moreover, by controlling the angle between the first heat exchange section 41 and the second heat exchange section 42 correspondingly to be 118°-145° by the fixation frame 70, the objects of reducing the space occupation rate of the heat exchanger 40 and reducing the overall machine size can be achieved. Furthermore, when the heat exchanger 40 is in the range of the angle of 118°-145°, the airflow at the heat exchanger 40 has a smoother flow line than in the case of any other configuration, the airflow noise is small, the loss in air pressure and air volume is small, and the energy efficiency attenuation is not obvious, which achieves the comprehensive object of giving consideration to product size, operation noise and energy efficiency.

Figure 8:
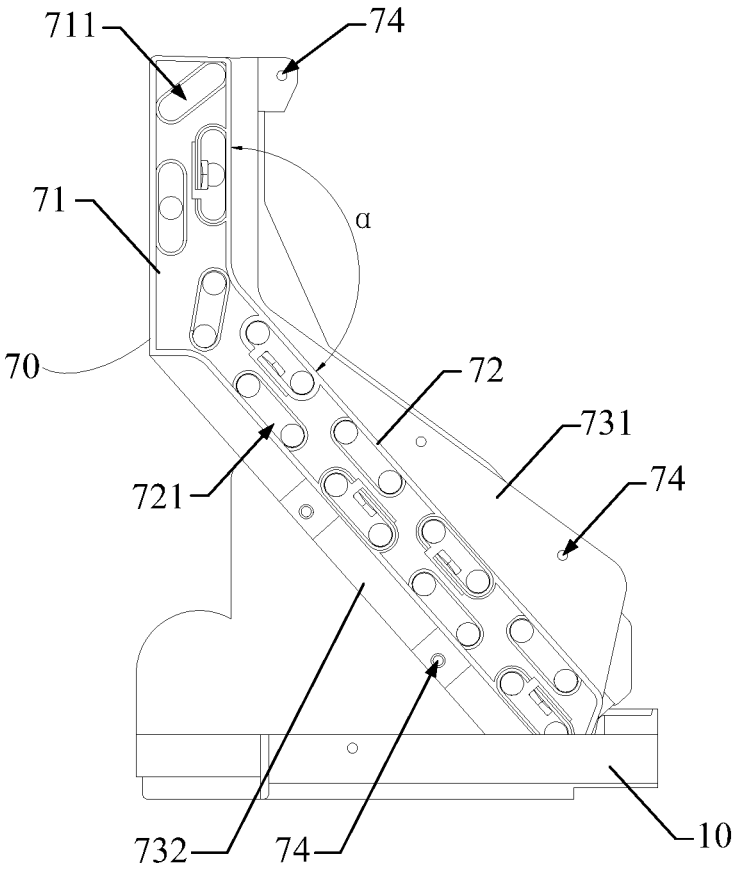
FIG. 8 is a schematic view of the partial structure of the window air conditioner shown in FIG. 6, at another angle.

In this embodiment, as shown in FIG. 8, the angle α between the first fixation section 71 and the second fixation section 72 is set to be 130.5°-140.5°, so that the angle between the first heat exchange section 41 and the second heat exchange section 42 fixed by the fixation frame 70 is correspondingly 130.5°-140.5°. In this way, the objects of reducing the space occupation rate of the heat exchanger 40 and reducing the overall machine size can be achieved, and when the heat exchanger 40 is in the range of the angle of 130.5°-140.5°, the smoothness of the flow line of the airflow at the heat exchanger 40 is further improved, the airflow noise is smaller, the loss in air pressure and air volume is further reduced, and the energy efficiency attenuation is not obvious, thereby achieving the comprehensive object of giving consideration to product size, operation noise and energy efficiency.

In some embodiments, the angle α between the first fixation section 71 and the second fixation section 72 is 133.5°-147.5°. In some embodiments, the angle α between the first fixation section 71 and the second fixation section 72 is 135.5°.

Figure 10:
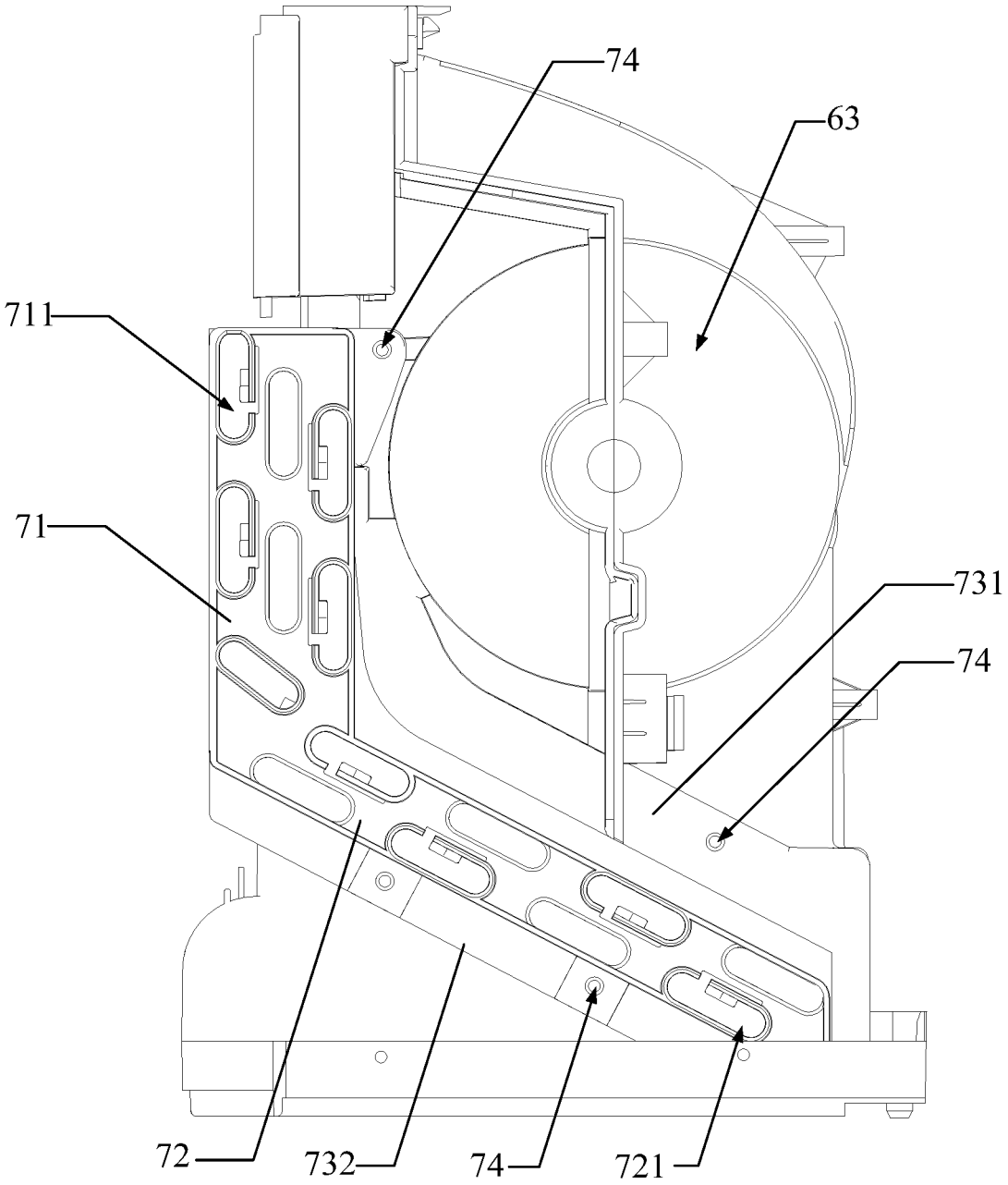
FIG. 10 is a partial structural view of the window air conditioner according to an embodiment of the present disclosure.

In a specific embodiment of the present disclosure, the first heat exchange section 41 and the second heat exchange section 42 are each provided with a plurality of heat exchange tubes, wherein as shown in FIG. 8 to FIG. 10, the first fixation section 71 is provided with first tube holes 711 configured to avoid the heat exchange tubes of the first heat exchange section 41, and the second fixation section 72 is provided with second tube holes 721 configured to avoid the heat exchange tubes of the second heat exchange section 42. In some embodiments, as shown in FIG. 8, FIG. 9 and FIG. 10, the first tube holes 711 on the first fixation section 71 and/or the second tube holes 721 on the second fixation section 72 are tube holes suitable for avoiding U-shaped heat exchange tubes.

In this solution, the first tube holes 711 are designed on the first fixation section 71 and the second tube holes 721 are designed on the second fixation section 72 to correspondingly avoid the heat exchange tubes of the first heat exchange section 41 and the heat exchange tubes of the second heat exchange section 42. In this structure, the first heat exchange section 41 and the first fixation section 71, and the second heat exchange section 42 and the second fixation section 72 may be positioned and limited by a nested structure formed between the tube holes and the heat exchange tubes, to ensure that the angle between the first fixation section 71 and the second fixation section 72 is the same as the angle between the first heat exchange section 41 and the second heat exchange section 42, thereby improving the accuracy of shaping of the first heat exchange section 41 and the second heat exchange section 42.

Figure 7:
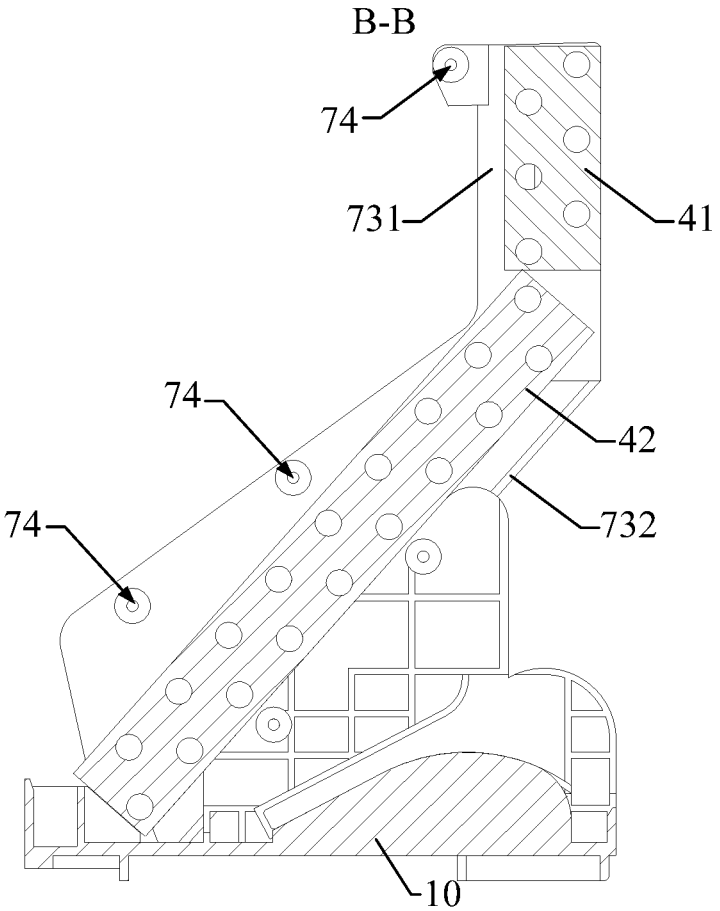
FIG. 7 is a schematic sectional view in the B-B direction shown in FIG. 6.

In some embodiments of the present disclosure, as shown in FIG. 7, FIG. 8 and FIG. 9, the first tube holes 711 on the first fixation section 71 are arranged in two rows, or as shown in FIG. 10, the first tube holes 711 on the first fixation section 71 are arranged in three rows. On the basis that the angle between the first fixation section 71 and the second fixation section 72 is 118°-145°, i.e., the angle between the first heat exchange section 41 and the second heat exchange section 42 is 118°-145°, by further arranging the first tube holes 711 on the first fixation section 71 in two rows or in three rows, it is possible to further improve the smoothness of the flow line of the airflow at the first fixation section 71, achieve the objects of reducing noise, reducing the loss in air pressure and reducing the loss in air volume, and effectively ensure the heat exchange efficiency of the heat exchanger 40, so as to realize comprehensive improvement of the energy efficiency of the equipment.

In some embodiments of the present disclosure, as shown in FIG. 7, FIG. 8, FIG. 9 and FIG. 10, the second tube holes 721 on the second fixation section 72 are arranged in two rows. Of course, the solution is not limited thereto, and a person skilled in the art may also design the second tube holes 721 on the second fixation section 72 to be arranged in three rows according to the needs.

On the basis that the angle between the first fixation section 71 and the second fixation section 72 is 118°-145°, i.e., the angle between the first heat exchange section 41 and the second heat exchange section 42 is 118°-145°. By further arranging the second tube holes 721 on the second fixation section 72 in two rows or in three rows, it is possible to further improve the smoothness of the flow line of the airflow at the second fixation section 72, achieve the objects of reducing noise, reducing the loss in air pressure and reducing the loss in air volume, and effectively ensure the heat exchange efficiency of the heat exchanger 40, so as to realize comprehensive improvement of the energy efficiency of the equipment.

In some embodiments of the present disclosure, as shown in FIG. 7, FIG. 8 and FIG. 9, the sum of the number of first tube holes 711 on the first fixation section 71 and the number of second tube holes 721 on the second fixation section 72 is 12, or as shown in FIG. 10, the sum of the number of first tube holes 711 on the first fixation section 71 and the number of second tube holes 721 on the second fixation section 72 is 15. Of course, the solution is not limited thereto, and a person skilled in the art may also design the sum of the number of first tube holes 711 on the first fixation section 71 and the number of second tube holes 721 on the second fixation section 72 to be 13 or 14 according to the needs. On the basis that the angle between the first fixation section 71 and the second fixation section 72 is 118°-145°, i.e., the angle between the first heat exchange section 41 and the second heat exchange section 42 is 118°-145°, by further design the sum of the number of first tube holes 711 on the first fixation section 71 and the number of second tube holes 721 on the second fixation section 72 to be 12-15, it is possible to further improve the smoothness of the flow line of the airflow at the second fixation section 72, achieve the objects of reducing noise, reducing the loss in air pressure and reducing the loss in air volume, and effectively ensure the heat exchange efficiency of the heat exchanger 40, so as to realize comprehensive improvement of the energy efficiency of the equipment.

In some embodiments of the present disclosure, as shown in FIG. 7 to FIG. 10, the fixation frame 70 is provided with a mounting structure for mounting and fixing the fixation frame 70.

Specifically, for example, the mounting structure comprises a first connection edge 731 of the fixation frame 70, the first connection edge 731 is used for fixed connection with a volute assembly 63 of the window air conditioner to realize the positioning and assembly of the fixation frame 70 and the volute assembly 63, as shown in FIG. 7 to FIG. 10. More specifically, for example, the first connection edge 731 is provided with a threaded hole 74, the volute assembly 63 is provided with a through hole or a screw hole, and the first connection edge 731 is fixed to the volute assembly 63 by threaded connection with a fastener such as a screw. As another example, the mounting structure comprises a second connection edge 732 on the fixation frame 70, the second connection edge 732 is used for fixed connection with the base 10 of the window air conditioner to realize the positioning and assembly of the fixation frame 70 and the base 10, as shown in FIG. 7 to FIG. 10. More specifically, for example, the second connection edge 732 is provided with a threaded hole 74, the base 10 is provided with a through hole 43 or a screw hole, and the second connection edge 732 is fixed to the base 10 by threaded connection with a fastener such as a screw. In this design, by providing a mounting structure on the fixation frame 70 for the assembly of the fixation frame 70 with other components of the window air conditioner, the assembly accuracy and efficiency between the heat exchanger 40 and other devices of the window air conditioner can be improved.

In a specific embodiment of the present disclosure, the fixation frame 70 is provided at the right side of the first heat exchange section 41 and the second heat exchange section 42 to fix the first heat exchange section 41 and the second heat exchange section 42.

In a specific embodiment of the present disclosure, the fixation frame 70 is provided at the left side of the first heat exchange section 41 and the second heat exchange section 42 to fix the first heat exchange section 41 and the second heat exchange section 42.

In a specific embodiment of the present disclosure, the fixation frame 70 is provided at both the left side and the right side of the first heat exchange section 41 and the second heat exchange section 42 to fix the first heat exchange section 41 and the second heat exchange section 42.

As shown in FIG. 11 to FIG. 15, in the window air conditioner provided by the embodiment of the present disclosure, the base 10 comprises a bracket and a water receiving groove 17 that are integrally formed with the base 10. Specifically, the bracket is provided with a fixation structure for fixing the heat exchanger 40. The fixation structure comprises a screw hole structure 19, the heat exchanger 40 is provided with a through hole 43 corresponding to the screw hole structure 19, and a threaded fastener is passed through the through hole 43 and threadedly connected to the screw hole structure 19.

The bracket further comprises two supporting plates 13 that are spaced apart from each other, and a rear abutment plate 14 located at one side of the two supporting plates 13, the heat exchanger 40 is supported by the two supporting plates 13, wherein plate edges of the two supporting plates 13 that are used for supporting the heat exchanger 40 are configured to be inclined shape, the portions of the heat exchanger 40 supported by the supporting plate 13 have an inclined shape adapted to the plate edges, and a bottom end portion of the heat exchanger 40 abuts against the rear abutment plate 14.

In this solution, the bracket and the water receiving groove 17 are integrally formed at the base 10 of the window air conditioner, wherein the water receiving groove 17 of the base 10 can collect the condensed water dripping from the heat exchanger 40, thereby reducing the possibility of failure of the window air conditioner due to the condensed water. The base 10 is integrally molded with the bracket and the water receiving groove 17, which reduces the number of parts of the window air conditioner, makes it more convenient to produce and assemble the window air conditioner, is also conducive in ensuring the assembly accuracy between the heat exchanger 40 and the water receiving groove 17, prevents the problem of water leakage caused by deviation of the heat exchanger 40 or the water receiving groove 17, and ensures the base 10, the water receiving groove 17 and the bracket to have relatively high connection strength therebetween, and to be less likely to be deformed or even broken.

At the time of mounting the heat exchanger 40, after the positioning of the heat exchanger 40 is completed, the threaded fastener is passed through the through hole 43 on the heat exchanger 40 and threadedly connected to the screw hole structure 19, so as to realize fixed connection between the heat exchanger 40 and the supporting plates 13. The use of the screw hole structure 19 and the threaded fastener leads to a simple structure, convenient assembly and disassembly, and more reliable connection.

Moreover, by disposing the heat exchanger 40 inclinedly on the supporting plates 13, the condensed water on the heat exchanger 40 can drip from the heat exchanger 40 more smoothly and fall into the water receiving groove 17, so as to reduce the possibility of accumulation of the condensed water on the surface of the heat exchanger 40, thereby reducing the influence of the condensed water on the heat exchange performance of the heat exchanger 40 and improving the stability of the heat exchange performance of the heat exchanger 40. In addition, by making the bottom end portion of the heat exchanger 40 abut against the rear abutment plate 14 after the heat exchanger 40 is connected to the two supporting plates 13, the rear abutment plate 14 can limit the displacement of the heat exchanger 40 towards one side of the rear abutment plate, which improves the reliability of the connection between the heat exchanger 40 and the base 10.

Figure 13:
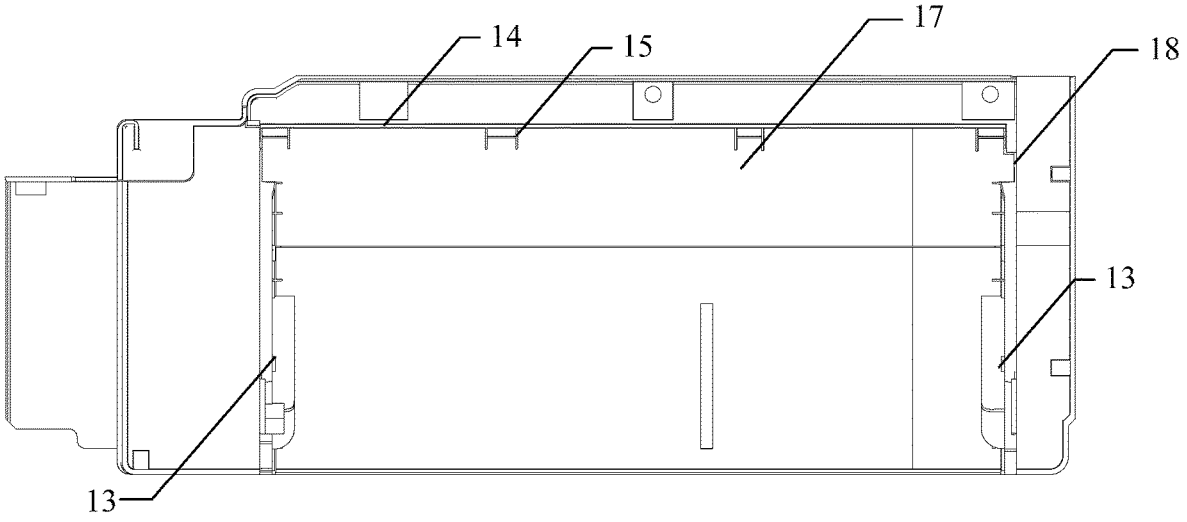
FIG. 13 is a schematic top view of the base according to an embodiment of the present disclosure.
Figure 14:
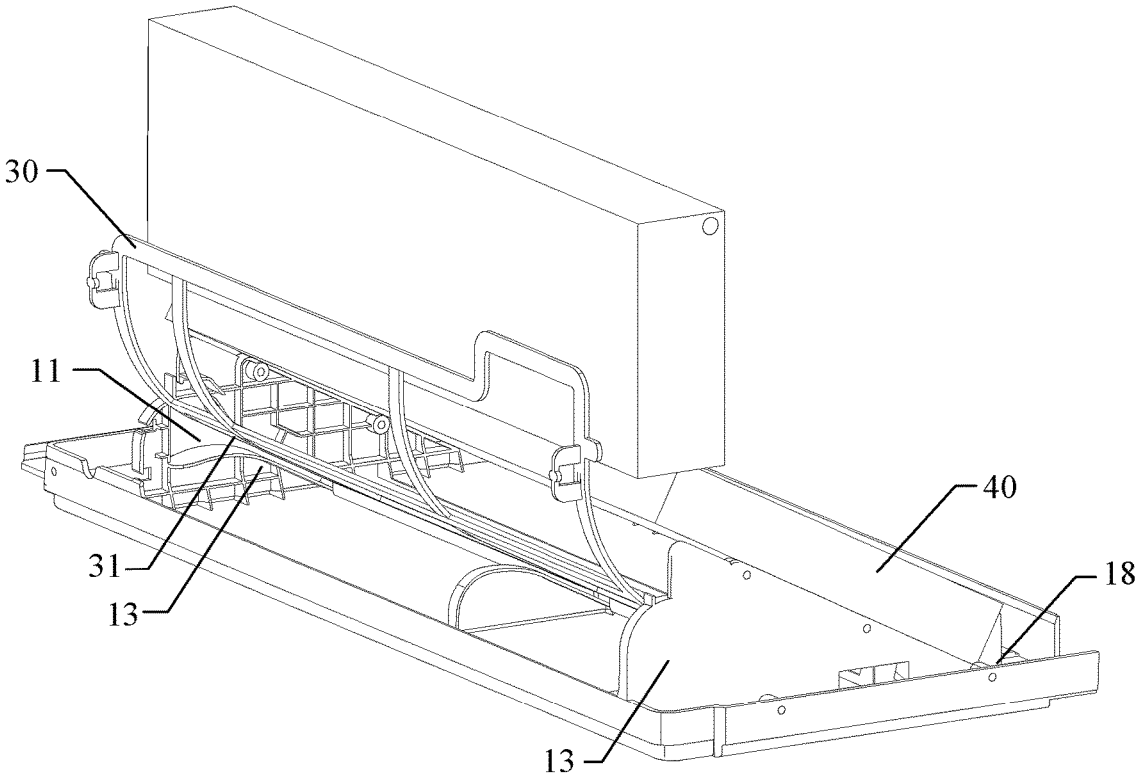
FIG. 14 is a schematic partial perspective view of the window air conditioner according to an embodiment of the present disclosure.
Figure 15:
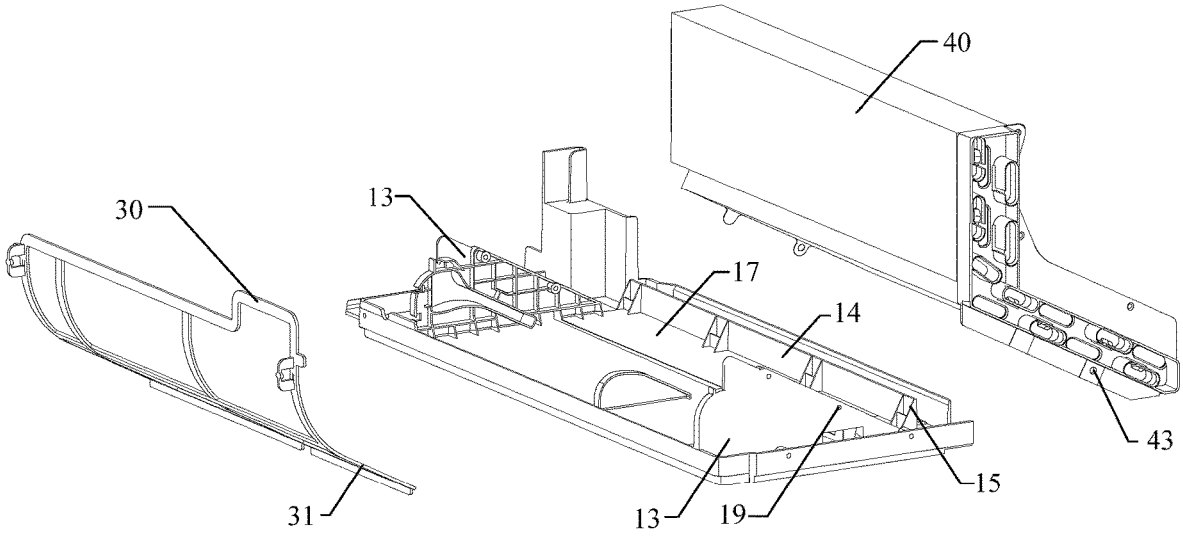
FIG. 15 is an exploded, perspective view of the window air conditioner according to an embodiment of the present disclosure.

In the present embodiment, as shown in FIG. 13 and FIG. 14, the spacing between the two supporting plates 13 is adapted to the width of the heat exchanger 40 such that the supporting position at which the supporting plates 13 support the heat exchanger 40 is adjacent to the side plate of the heat exchanger 40. In this way, the influence of the two supporting plates 13 on the air intake of the heat exchanger 40 can be reduced, that is, the wind resistance of the heat exchanger 40 can be reduced, which facilitates improving the air intaking efficiency of the heat exchanger 40 and further improves the heat exchange performance of the heat exchanger 40.

In the above, the supporting plate 13 and the side plate are in contact with each other, or have a non-zero interval therebetween.

In the present embodiment, as shown in FIG. 11 to FIG. 14, the two supporting plates 13 are configured such that when the heat exchanger 40 is supported by the two supporting plates 13, the two supporting plates 13 are located between two side plates of the heat exchanger 40, and the two side plates of the heat exchanger 40 clamp the two supporting plates 13 towards each other. In this way, the two supporting plates 13 are clamped against each other by the two side plates of the heat exchanger 40, and the displacement of the heat exchanger 40 in the width direction can be restricted by the abutment between the supporting plates 13 and the two side plates, thereby improving the reliability of the connection between the heat exchanger 40 and the supporting plates 13, and further improving the reliability of the connection between the heat exchanger 40 and the base 10.

Figure 11:
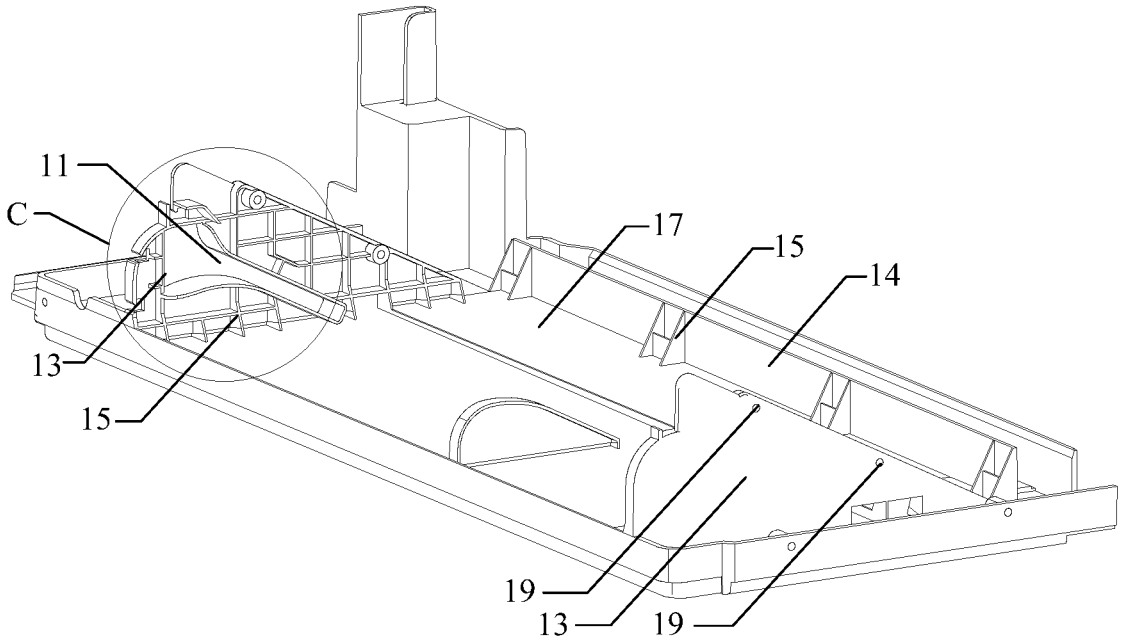
FIG. 11 is a schematic perspective view of the base according to an embodiment of the present disclosure.
Figure 12:
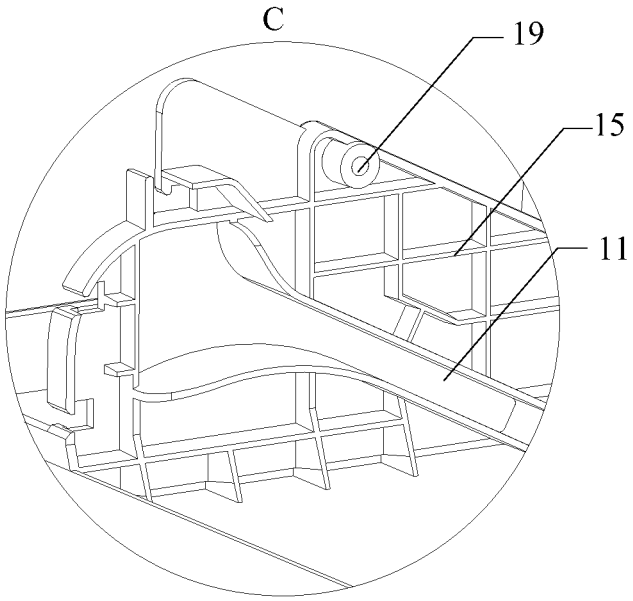
FIG. 12 is a partially enlarged view of part C shown in FIG. 11.

In the present embodiment, as shown in FIG. 11, FIG. 12 and FIG. 13, the supporting plates 13 and the rear abutment plate 14 are each provided with reinforcing ribs 15. The reinforcing ribs 15 that are provided at the supporting plate 13 in an intersected manner can improve the strength of the supporting plate 13 and reduce the possibility of bending of the supporting plate 13, thereby improving the reliability of the connection between the heat exchanger 40 and the base 10. The reinforcing ribs 15 provided at intervals on the rear abutment plate 14 can improve the strength of the rear abutment plate 14, so as to reduce the possibility of the heat exchanger 40 moving towards one side of the rear abutment plate 14 and improve the reliability of the connection between the heat exchanger 40 and the base 10. In the present embodiment, by providing the reinforcing ribs 15 on both the supporting plates 13 and the rear abutment plate 14, the reliability of the connection between the heat exchanger 40 and the base 10 are greatly improved.

In the present embodiment, as shown in FIG. 11, FIG. 12 and FIG. 14, the bracket is provided with a first fixation member for mounting the filter 30. More specifically, the first fixation member comprises a guide rail groove 11 or a guide rail, and the filter 30 is provided with a track 31 configured to be slidably connected to the guide rail groove 11 or the guide rail.

The first fixation member is the guide rail groove 11 or the guide rail, which is selected according to the use environment to meet different use needs. The track 31 is configured according to whether the first fixation member is the guide rail groove 11 or the guide rail. For example, when the first fixation member is the guide rail groove 11, the track 31 is accordingly a guide rail capable of being slidably connected with the guide rail groove 11, and when the first fixation member is a guide rail, the track 31 is accordingly a guide rail groove capable of being slidably connected with the guide rail.

In other embodiments, the first fixation member may be configured to comprise a clamping groove, the filter 30 is provided with a hook that cooperates with the clamping groove, and the bracket and the filter 30 are fixedly connected by the cooperation between the clamping groove and the hook. The bracket and the filter 30 are fixedly connected by the cooperation between the hook and the clamping groove, which leads to convenient assembly and disassembly of the bracket and the filter 30 and facilitates the cleaning of the filter 30 during use.

In the present embodiment, as shown in FIG. 11, FIG. 13, FIG. 14 and FIG. 15, the base 10 is an indoor-side base 10 of the window air conditioner, wherein the base 10 is provided with a water discharge opening 18 for discharging water to the outdoor side of the window air conditioner, and the water discharge opening 18 communicates with the water receiving groove 17.

In the above, the water receiving groove 17 in this embodiment is composed of the rear abutment plate 14, the two supporting plates 13, and protruding ribs on the base 10 that are connected to the two supporting plates 13.

As shown in FIG. 6 to FIG. 10, an embodiment of the present disclosure further provides a fixation frame 70 for the heat exchanger 40, the heat exchanger 40 adapted thereto comprises a first heat exchange section 41 and a second heat exchange section 42, wherein the fixation frame 70 has a two-section structure and comprises a first fixation section 71 for fixing the first heat exchange section 41 and a second fixation section 72 for fixing the second heat exchange section 42, and the angle $\alpha$ between the first fixation section 71 and the second fixation section 72 is 118°-145°.

For the fixation frame 70 of the heat exchanger 40 provided by the above embodiment of the present disclosure, a first fixation section 71 and a second fixation section 72 are provided to fix the first heat exchange section 41 and the second heat exchange section 42, respectively. In this way, the assembled and constructed heat exchanger 40 as a whole can be shaped to have an angle of 118°-145°, which achieves a good shaping effect on the heat exchanger 40 and enables convenient assembly. Moreover, by controlling the angle between the first heat exchange section 41 and the second heat exchange section 42 correspondingly to be 118°-145° by the fixation frame 70, the objects of reducing the space occupation rate of the heat exchanger 40 and reducing the overall machine size can be achieved. Furthermore, when the heat exchanger 40 is in the range of the angle of 118°-145°, the airflow at the heat exchanger 40 has a smoother flow line than in the case of any other configuration, the airflow noise is small, the loss in air pressure and air volume is small, and the energy efficiency attenuation is not obvious, which achieves the comprehensive object of giving consideration to product size, operation noise and energy efficiency.

Further, as shown in FIG. 8, the angle $\alpha$ between the first fixation section 71 and the second fixation section 72 is 130.5°-140.5°. In this way, the objects of reducing the space occupation rate of the heat exchanger 40 and reducing the overall machine size are achieved, and the smoothness of the flow line of the airflow at the heat exchanger 40 is further improved, the airflow noise is smaller, the loss in air pressure and air volume is further reduced, and the energy efficiency attenuation is not obvious, thereby achieving the comprehensive object of giving consideration to product size, operation noise and energy efficiency.

In some embodiments, the angle α between the first fixation section 71 and the second fixation section 72 is 133.5°-147.5°. In some embodiments, the angle α between the first fixation section 71 and the second fixation section 72 is 135.5°.

Further, the first heat exchange section 41 and the second heat exchange section 42 are each provided with a plurality of heat exchange tubes, wherein as shown in FIG. 8 to FIG. 10, the first fixation section 71 is provided with tube holes configured to avoid the heat exchange tubes of the first heat exchange section 41, and the second fixation section 72 is provided with tube holes configured to avoid the heat exchange tubes of the second heat exchange section 42. In some embodiments, as shown in FIG. 8, FIG. 9 and FIG. 10, the tube holes on the first fixation section 71 and/or the second fixation section 72 are tube holes suitable for avoiding U-shaped heat exchange tubes.

Further, as shown in FIG. 7, FIG. 8 and FIG. 9, the tube holes on the first fixation section 71 are arranged in two rows, or as shown in FIG. 10, the tube holes on the first fixation section 71 are arranged in three rows.

In some embodiments, as shown in FIG. 7, FIG. 8, FIG. 9 and FIG. 10, the tube holes on the second fixation section 72 are arranged in two rows. Of course, the solution is not limited thereto, and a person skilled in the art may also design the tube holes on the second fixation section 72 to be arranged in three rows according to the needs.

Further, as shown in FIG. 7, FIG. 8 and FIG. 9, the sum of the number of tube holes on the first fixation section 71 and the number of tube holes on the second fixation section 72 is 12, or as shown in FIG. 10, the sum of the number of tube holes on the first fixation section 71 and the number of tube holes on the second fixation section 72 is 15. Of course, the solution is not limited thereto, and a person skilled in the art may also design the sum of the number of tube holes on the first fixation section 71 and the number of tube holes on the second fixation section 72 to be 13 or 14 according to the needs.

Further, as shown in FIG. 7 to FIG. 10, the fixation frame 70 is provided with a mounting structure for mounting and fixing the fixation frame 70. Specifically, for example, the mounting structure comprises a first connection edge 731 on the fixation frame 70, the first connection edge 731 is used for fixed connection with a volute assembly 63 of the air conditioner to realize the positioning and assembly of the fixation frame 70 and the volute assembly 63, as shown in FIG. 7 to FIG. 10. More specifically, for example, the first connection edge 731 is provided with a threaded hole 74, the volute assembly 63 is provided with a through hole 43 or a screw hole, and the first connection edge 731 is fixed to the volute assembly 63 by threaded connection with a fastener such as a screw. As another example, the mounting structure comprises a second connection edge 732 on the fixation frame 70, the second connection edge 732 is used for fixed connection with the base 10 of the air conditioner to realize the positioning and assembly of the fixation frame 70 and the base 10, as shown in FIG. 7 to FIG. 10. More specifically, for example, the second connection edge 732 is provided with a threaded hole 74, the base 10 is provided with a through hole 43 or a screw hole, and the second connection edge 732 is fixed to the base 10 by threaded connection with a fastener such as a screw. In this design, by providing a mounting structure on the fixation frame 70 for the assembly of the fixation frame 70 with other components of the air conditioner, the assembly accuracy and efficiency between the heat exchanger 40 and other devices of the air conditioner can be improved.

As shown in FIG. 9, an embodiment of the present disclosure further provides a heat exchanger 40, comprising: a first heat exchange section 41; a second heat exchange section 42; and the fixation frame 70 of the heat exchanger 40 of any of the above embodiments, wherein the first heat exchange section 41 is connected to the first fixation section 71 of the fixation frame 70, the second heat exchange section 42 is connected to the second fixation section 72 of the fixation frame 70, and the angle between the first heat exchange section 41 and the second heat exchange section 42 is the same as the angle between the first fixation section 71 and the second fixation section 72.

The heat exchanger 40 described in the above embodiment of the present disclosure is provided with the fixation frame 70 of the heat exchanger 40 described in any of the above embodiments, and therefore has all of the above advantageous effects, which will not be described here.

In some embodiments, the fixation frame 70 is provided at the right side of the first heat exchange section 41 and the second heat exchange section 42 to fix the first heat exchange section 41 and the second heat exchange section 42. Of course, it is also feasible to design that the fixation frame 70 is provided at the left side of the first heat exchange section 41 and the second heat exchange section 42 to fix the first heat exchange section 41 and the second heat exchange section 42, or even that the fixation frame 70 is provided at both the left side and the right side of the first heat exchange section 41 and the second heat exchange section 42 to fix the first heat exchange section 41 and the second heat exchange section 42.

As shown in FIG. 6, FIG. 7, FIG. 8 and FIG. 10, an embodiment of the present disclosure further provides an air conditioner, comprising the heat exchanger described in any of the above embodiments.

The air conditioner described in the above embodiment of the present disclosure is provided with the heat exchanger described in any of the above embodiments, and therefore has all of the above advantageous effects, which will not be described here.

Optionally, the air conditioner is a window air conditioner.

As shown in FIG. 11 to FIG. 15, an embodiment of the present disclosure further provides a base 10, comprising a bracket and a water receiving groove 17 that are integrally formed therewith.

Specifically, the bracket is provided with a fixation structure for fixing the heat exchanger 40. The fixation structure comprises a screw hole structure 19, the heat exchanger 40 is provided with a through hole 43 corresponding to the screw hole structure 19, and a threaded fastener is passed through the through hole 43 and threadedly connected to the screw hole structure 19. The bracket further comprises two supporting plates 13 that are spaced apart from each other, and a rear abutment plate 14 located at one side of the two supporting plates 13, the heat exchanger 40 is supported by the two supporting plates 13, wherein plate edges of the two supporting plates 13 that are used for supporting the heat exchanger 40 are configured to be inclined shape, the portions of the heat exchanger 40 supported by the supporting plates 13 have an inclined shape adapted to the plate edges, and a bottom end portion of the heat exchanger 40 abuts against the rear abutment plate 14.

In some embodiments, as shown in FIG. 13 and FIG. 14, the spacing between the two supporting plates 13 is adapted to the width of the heat exchanger 40 such that the supporting position at which the supporting plates 13 support the heat exchanger 40 is adjacent to the side plate of the heat exchanger 40, wherein the supporting plate 13 and the side plate are in contact with each other, or have a non-zero interval therebetween.

In some embodiments, as shown in FIG. 11 to FIG. 14, the two supporting plates 13 are configured such that when the heat exchanger 40 is supported by the two supporting plates 13, the two supporting plates 13 are located between two side plates of the heat exchanger 40, and the two side plates of the heat exchanger 40 clamp the two supporting plates 13 towards each other. In this way, the two supporting plates 13 are clamped against each other by the two side plates of the heat exchanger 40, and the displacement of the heat exchanger 40 in the width direction can be restricted by the abutment between the supporting plates 13 and the two side plates, thereby improving the reliability of the connection between the heat exchanger 40 and the supporting plates 13, and further improving the reliability of the connection between the heat exchanger 40 and the base 10.

In some embodiments, as shown in FIG. 11 to FIG. 13, the supporting plate 13 and the rear abutment plate 14 are each provided with reinforcing ribs 15.

In some embodiments, as shown in FIG. 11, FIG. 12 and FIG. 14, the bracket is provided with a first fixation member for mounting the filter 30. More specifically, the first fixation member comprises a guide rail groove 11 or a guide rail, and the filter 30 is provided with a track 31 configured to be slidably connected to the guide rail groove 11 or the guide rail.

The first fixation member is the guide rail groove 11 or the guide rail, which is selected according to the use environment to meet different use needs. The track 31 is configured according to whether the first fixation member is the guide rail groove 11 or the guide rail. For example, when the first fixation member is the guide rail groove 11, the track 31 is accordingly a guide rail capable of being slidably connected with the guide rail groove 11, and when the first fixation member is a guide rail, the track 31 is accordingly a guide rail groove capable of being slidably connected with the guide rail.

Of course, it is also feasible to design that the first fixation member comprises a clamping groove, the filter 30 is provided with a hook that cooperates with the clamping groove, and the bracket and the filter 30 are fixedly connected by the cooperation between the clamping groove and the hook.

In some embodiments, as shown in FIG. 11, FIG. 13, FIG. 14 and FIG. 15, the base 10 is an indoor-side base of the window air conditioner, wherein the base 10 is provided with a water discharge opening 18 for discharging water to the outdoor side of the window air conditioner, and the water discharge opening 18 communicates with the water receiving groove 17.

In some embodiments, the water receiving groove 17 is composed of the rear abutment plate 14, the two supporting plates 13, and protruding ribs on the base 10 that are connected to the two supporting plates 13.

In the present disclosure, the terms "first", "second", and "third" are used for the purpose of description only, and cannot be understood as indicating or implying relative importance; the term "a plurality of" means two or more, unless otherwise explicitly defined. The terms "mounting", "connected", "connection", "fixing" and the like should be understood in a broad sense. For example, "connection" may be a fixed connection, a removable connection or an integral connection; the term "connected" may refer to being directly connected and may also refer to being indirectly connected through an intermediary. A person of ordinary skills in the art could understand the specific meaning of the terms in the present disclosure according to specific situations.

In the description of the present disclosure, it should be understood that the orientation or position relationships indicated by the terms "upper", "lower", "left", "right", "front", "back" and the like are the orientation or position relationships based on what is shown in the drawings, are merely for the convenience of describing the present disclosure and simplifying the description, and do not indicate or imply that the device or unit referred to must have a particular direction and is constructed and operated in a specific orientation, and thus cannot be understood as the limitation of the present disclosure.

In the description of the present specification, the descriptions of the terms "one embodiment", "some embodiments" and "specific embodiments" and the like mean that specific features, structures, materials or characteristics described in conjunction with the embodiment(s) or example(s) are included in at least one embodiment or example of the present disclosure. In the specification, the schematic representation of the above terms does not necessarily refer to the same embodiment or example. Moreover, the particular features, structures, materials or characteristics described may be combined in a suitable manner in any one or more embodiments or examples.

The descriptions above are only some embodiments of the present disclosure, which are not used to limit the present disclosure. For a person skilled in the art, the present disclosure may have various changes and variations. Any modifications, equivalent substitutions, improvements, etc., within the spirit and principle of the present disclosure shall all be included in the scope of the present disclosure.

What is claimed is:

1. An air conditioner comprising:

a base including a first fixation member;

a front panel including a second fixation member; and a filter, one end of the filter being detachably connected to the first fixation member, and another end of the filter being detachably connected to the second fixation member;

wherein at least one of the base or the front panel includes a supporting member abutting against the filter to cause the filter to bend in an arc shape.

2. The air conditioner according to claim 1, wherein one of the first fixation member and the second fixation member includes a guide rail groove or a guide rail;

the filter includes a track configured to be slidably connected with the guide rail groove or the guide rail; and the filter is shaped by the guide rail groove or the guide rail to have a shape matching a shape of the guide rail groove or the guide rail.

3. The air conditioner according to claim 2, wherein the guide rail groove or the guide rail is oblique line-shaped or arc-shaped.

4. The air conditioner according to claim 2, wherein:

the one of the first fixation member and the second fixation member includes the guide rail groove; and an entrance of the guide rail groove is configured to have a trumpet shape.

5. The air conditioner according to claim 4, wherein a surface of the entrance of the guide rail groove has an arc shape.

6. The air conditioner according to claim 2, wherein:
the track is a first track;
the filter further includes a second track spaced apart from the first track; and
the supporting member includes a supporting rib supporting a portion of the filter between the first track and the second track.

7. The air conditioner according to claim 1, wherein:
one of the first fixation member and the second fixation member includes a locking groove; and
the filter includes a convex rib configured to be snapped into the locking groove to fix the filter.

8. The air conditioner according to claim 7, wherein the one of the first fixation member and the second fixation member further includes a stopping member located at a groove opening of the locking groove and configured to limit the convex rib in the locking groove.

9. The air conditioner according to claim 7, wherein:
the supporting member includes a supporting rib having an arc shape; and
the convex rib is configured to be snapped into the locking groove to press the filter against a surface of the supporting rib.

10. The air conditioner according to claim 7, wherein the filter includes a clasp configured to be lifted to disengage the convex rib from the locking groove.

11. The air conditioner according to claim 1, wherein at least one of the front panel or the base includes an air inlet.

12. The air conditioner according to claim 1, further comprising:
a heat exchanger disposed at the base.

13. The air conditioner according to claim 12, further comprising:
a cross-flow impeller arranged adjacent to the heat exchanger.

14. The air conditioner according to claim 13, wherein:
the heat exchanger includes a first heat exchange section and a second heat exchange section having an angle smaller than 180° therebetween; and
the cross-flow impeller is located at one side of the heat exchanger that is inwardly recessed.

15. The air conditioner according to claim 14, further comprising:
a volute tongue plate arranged adjacent to one end of the first heat exchange section.

16. The air conditioner according to claim 14, wherein a perpendicular foot of a center of the cross-flow impeller on a surface of the first heat exchange section is closer to another end of the first heat exchange section than to the one end of the first heat exchange section.

17. The air conditioner according to claim 14, wherein a smallest vertical distance between a surface of the first heat exchange section and an outer surface of the cross-flow impeller is smaller than a smallest vertical distance between a surface of the second heat exchange section and the outer surface of the cross-flow impeller.

18. The air conditioner according to claim 14, wherein a perpendicular foot of a center of the cross-flow impeller on a surface of the second heat exchange section is closer to one end of the second heat exchange section that is adjacent to the first heat exchange section than to another end of the second heat exchange section that is away from the first heat exchange section.

19. The window air conditioner according to claim 12, wherein:
the heat exchanger includes:
a first heat exchange section;
a second heat exchange section; and
a fixation frame including:
a first fixation section connected to the first heat exchange section; and
a second fixation section connected to the second heat exchange section; and
an angle between the first heat exchange section and the second heat exchange section is same as an angle between the first fixation section and the second fixation section.

20. The air conditioner according to claim 1, wherein the base includes:
a bracket including a fixation structure configured to fix the heat exchanger; and
a water receiving tank configured to receive water from the heat exchanger.

* * * * *